US008994606B2

(12) United States Patent
Yamamoto et al.

(10) Patent No.: US 8,994,606 B2
(45) Date of Patent: Mar. 31, 2015

(54) ANTENNA AND RADIO COMMUNICATION DEVICE

(75) Inventors: Naotake Yamamoto, Osaka (JP); Koichi Ogawa, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 364 days.

(21) Appl. No.: 13/265,951

(22) PCT Filed: Feb. 14, 2011

(86) PCT No.: PCT/JP2011/000784

§ 371 (c)(1),
(2), (4) Date: Oct. 24, 2011

(87) PCT Pub. No.: WO2011/105019

PCT Pub. Date: Sep. 1, 2011

(65) Prior Publication Data

US 2012/0038537 A1 Feb. 16, 2012

(30) Foreign Application Priority Data

Feb. 26, 2010 (JP) ..... 2010-042977

(51) Int. Cl.

| | |
|---|---|
| ***H01Q 9/38*** | (2006.01) |
| ***H01Q 1/12*** | (2006.01) |
| ***H01Q 1/27*** | (2006.01) |
| ***H01Q 9/04*** | (2006.01) |
| ***H01Q 9/42*** | (2006.01) |

(52) U.S. Cl.

CPC ..... *H01Q 1/273* (2013.01); *H01Q 9/0421* (2013.01); *H01Q 9/42* (2013.01)

USPC ..... 343/829; 343/718

(58) Field of Classification Search

USPC ..... 343/702, 718

See application file for complete search history.

(56) References Cited

U.S. PATENT DOCUMENTS

| | | | | |
|---|---|---|---|---|
| 5,598,169 | A * | 1/1997 | Drabeck et al. | 343/701 |
| 6,147,652 | A * | 11/2000 | Sekine | 343/702 |
| 6,211,840 | B1 * | 4/2001 | Wood et al. | 343/793 |
| 6,314,273 | B1 | 11/2001 | Matsuda | |
| 7,872,605 | B2 * | 1/2011 | Baliarda et al. | 343/700 MS |
| 2002/0019247 | A1 | 2/2002 | Egorov | |

(Continued)

FOREIGN PATENT DOCUMENTS

| | | |
|---|---|---|
| EP | 1 291 968 | 3/2003 |
| JP | 11-154815 | 6/1999 |

(Continued)

OTHER PUBLICATIONS

International Search Report issued May 10, 2011 in corresponding International Application No. PCT/JP2011/000784.

(Continued)

*Primary Examiner* — Hoang V Nguyen
*Assistant Examiner* — Patrick Holecek

(57) ABSTRACT

Provided is an antenna including a planar conductor to be grounded, and a three-dimensional linear conductor having at least a linear conductor, another linear conductor, and still another linear conductor that are integrally formed. The linear conductor is provided perpendicularly to the major surface of the planar conductor. The another linear conductor is parallel to the major surface. Still another linear conductor is parallel to the major surface, and is provided perpendicularly to the another linear conductor.

13 Claims, 31 Drawing Sheets

(56) References Cited

U.S. PATENT DOCUMENTS

| | | | | |
|---|---|---|---|---|
| 2003/0025637 | A1* | 2/2003 | Mendolia et al. | 343/702 |
| 2009/0322631 | A1* | 12/2009 | Huchard et al. | 343/720 |
| 2010/0194658 | A1 | 8/2010 | Yukimoto et al. | |

FOREIGN PATENT DOCUMENTS

| | | |
|---|---|---|
| JP | 2005-244283 | 9/2005 |
| JP | 2009-017250 | 1/2009 |
| JP | 2009-17251 | 1/2009 |
| JP | 2009-100032 | 5/2009 |

OTHER PUBLICATIONS

Extended European Search Report mailed Jan. 3, 2014 in corresponding European Application No. 11746992.4.

Chinese Office Action with Search Report mailed Dec. 26, 2013 for corresponding Chinese Patent Application No. 201180001823.0 (including English translation of Search Report).

Andrea Sani et al., "An Efficient FDTD Algorithm Based on the Equivalence Principle for Analyzing Onbody Antenna Performance", IEEE Transactions on Antennas and Propagation, vol. 57, No. 4, Apr. 2009, pp. 1006-1014.

* cited by examiner (a) x-y plane (b) z-y plane (c) z-x plane

ANTENNA AND RADIO COMMUNICATION DEVICE

TECHNICAL FIELD

The present invention relates to an antenna and a radio communication device that are used for radio communication.

BACKGROUND ART

In recent years, much attention is focused on WBAN (Wireless Body Area Network) for performing short range radio communication in a relatively small area for an application such as medical care and health care. WBAN is a network for a user to perform communication while carrying or wearing a radio communication device with a built-in sensor or IC (Integrated Circuit) for biometric monitoring. In this case, WBAN is used for the purpose of improving real time performance and efficiency by collecting and transmitting data such as biometric information. Here, the biometric information indicates information such as a user's body temperature, pulse, and/or blood pressure.

FIG. 32 is an illustration showing an example of the WBAN system configuration.

In the WBAN system shown in FIG. 32, a sensor node 501 and a master node 502 communicate in a network NW10 in the vicinity of a human body. Each of the sensor node 501 and the master node 502 is a radio communication device. The sensor node 501 and the master node 502 are attached to respective locations of a human body (user). Each sensor node 501 acquires biometric information, and transmits the biometric information to the master node 502.

The master node 502 receives the biometric information from each sensor node 501.

The master node 502 communicates with an external device 500. The master node 502 transmits the biometric information received from each master node 502, to the external device 500.

The external device 500 notifies a user of his/her state of health in real time based on the received biometric information. Also, the external device 500 notifies the biometric information to a medical institution such as a hospital, thereby serving the purpose of early detection of disease for the user.

The sensor nodes attached to respective locations of a human body (user) may directly communicate with the external device 500 without utilizing the master node 502.

The system using a conventional short range radio communication includes RFID (Radio Frequency Identification) system. The RFID system includes an IC card system which performs data recording and reading using radio waves for ticket gate management, entrance/exit management, and the like, and a product distribution system using labels or product tags. That is to say, the RFID system is currently utilized in many fields.

Patent Literature 1 discloses an antenna constituting a plurality of linear conductors (hereinafter referred to as a conventional antenna) formed on a planar housing, as an antenna to be mounted on a radio communication device used in these RFID systems.

CITATION LIST

Patent Literature

[PTL 1]
Japanese Unexamined Patent Application Publication No. 2005-244283

SUMMARY OF INVENTION

Technical Problem

However, the conventional antenna is formed on a plane. That is to say, the shape of the conventional antenna is planar. Accordingly, on a plane perpendicular to the antenna, there is a large variation in the directivity of the radio waves emitted from the conventional antenna. That is to say, in the conventional antenna, there exists a location (null point) on a plane where the electric field strength is significantly reduced, depending on the position of the plane in relation to the conventional antenna.

Here, the conventional antenna is assumed to be used in the WBAN system. In this case, as shown in (a) in FIG. 33, the attachment position of each radio communication device (the sensor node 501, the master node 502) is different for each user. In addition, as shown in (b) in FIG. 33, the attachment orientation of each radio communication device (the sensor node 501, the master node 502) may vary for each user. Also, as shown in (c) in FIG. 33, the orientation of the radio communication device (the sensor nodes 501) may vary due to the user's movement.

Therefore, the directivity of the antenna may vary three-dimensionally, and the communication may be temporarily disconnected depending on a user's posture or movement. This is because, on a plane in the three-dimensional space, there exists a large variation in the directivity of the radio waves emitted from the conventional antenna. That is to say, there exists a location (null point) on the plane where the electric field strength is significantly reduced in the conventional antenna, depending on the position of the plane in relation to the conventional antenna.

The present invention has been made to solve the above-described problem, and it is an object of the invention to provide an antenna that prevents an occurrence of a location on the orthogonal planes in the three-dimensional space, where the electric field strength is significantly reduced.

Solution to Problem

In order to solve the above-described problem, an antenna according to one aspect of the present invention is used for radio communication. The antenna includes a planar conductor which is grounded; and a three-dimensional linear conductor in which at least a first linear conductor, a second linear conductor, and a third linear conductor are integrally formed, wherein the first linear conductor is provided on a major surface side of the planar conductor and perpendicularly to the major surface, the second linear conductor is provided on the major surface side and parallel to the major surface, the third linear conductor is provided on the major surface side, parallel to the major surface, and perpendicularly to the second linear conductor, one end of the second linear conductor and one end of the third linear conductor are electrically connected to each other, the planar conductor is provided with a power feed point, to which a high frequency current used for the radio communication is externally supplied, the power feed point being electrically disconnected to the planar conductor, the power feed point is electrically connected to one end of the first linear conductor of the three-dimensional linear conductor, the three-dimensional linear conductor has a flow of the high frequency current therethrough, a current flows through the planar conductor due to the flow of the high frequency current through the three-dimensional linear conductor, and a relationship of Mx=My=Mz is satisfied, where Mx denotes an electromagnetic moment Ix×Lx, My denotes an electromagnetic moment Iy×Ly, and Mz denotes an electromagnetic moment Iz1×Lz1−Iz2×Lz2, Ix denotes a current flowing along an x-axis out of the high frequency current flowing through the three-dimensional linear conductor where Ix is represented by a positive value when the current flows in +x direction, Iy denotes a current flowing along a y-axis out of the high frequency current flowing through the three-dimensional linear conductor where Iy is represented by a positive value when the current flows in +y direction, Iz1 denotes a current flowing along a z-axis out of the current flowing through the planar conductor where Iz1 is represented by a positive value when the current flows in +z direction, Iz2 denotes a current flowing along the z-axis out of the high frequency current flowing through the three-dimensional linear conductor where Iz2 is represented by a positive value when the current flows in +z direction, Lx denotes a length of the three-dimensional linear conductor in the x-axis direction, Ly denotes a length of the three-dimensional linear conductor in the y-axis direction, Lz1 denotes a length of the planar conductor in the z-axis direction, Lz2 denotes a length of the three-dimensional linear conductor in the z-axis direction, and in a three-dimensional coordinate system in which the x-axis, the y-axis and the z-axis are perpendicular to each other, the major surface of the planar conductor is parallel to the z-y plane of the three-dimensional coordinate system, the +x direction denotes one of two directions along the x-axis, −x direction denotes the other of the two directions along the x-axis, the +y direction denotes one of two directions along the y-axis, −y direction denotes the other of the two directions along the y-axis, the +z direction denotes one of two directions along the z-axis, −z direction denotes the other of the two directions along the z-axis.

That is to say, the antenna includes a planar conductor and a three-dimensional linear conductor in which at least a first linear conductor, a second linear conductor, and a third linear conductor are integrally formed. The first linear conductor is provided perpendicularly to the major surface of the planar conductor. The second linear conductor is parallel to the major surface. The third linear conductor is provided parallel to the major surface, and perpendicularly to the second linear conductor.

Also, the antenna is configured in such a manner that all the electromagnetic moments Mx, My, and Mz are equal where Mx denotes Ix×Lx, My denotes Iy×Ly, and Mz denotes Iz1×Lz1−Iz2×Lz2.

By the simulation and the measurement of a prototype antenna, the inventors have verified that an antenna, which is configured in such a manner that all the electromagnetic moments Mx, My, and Mz are equal, prevents an occurrence of a location on the orthogonal planes in the three-dimensional space, at which the electric field strength is significantly reduced where Mx denotes Ix×Lx, My denotes Iy×Ly, and Mz denotes Iz1×Lz1−Iz2×Lz2.

Accordingly, the antenna prevents an occurrence of a location on the orthogonal planes in the three-dimensional space, at which the electric field strength is significantly reduced.

Preferably, the planar conductor has a quadrilateral shape, and the power feed point is provided in the vicinity of an edge of the planar conductor.

Preferably, the three-dimensional linear conductor includes the first linear conductor, the second linear conductor, the third linear conductor, and a fourth linear conductor that are integrally formed, the fourth linear conductor is provided on the major surface side, the fourth linear conductor is parallel to the first linear conductor, the fourth linear conductor has the same length as the first linear conductor, and the other end of the second linear conductor and the planar conductor are electrically connected to each other via the fourth linear conductor.

Preferably, the length of the planar conductor in the z-axis direction, and respective lengths of the first linear conductor, the second linear conductor, the third linear conductor, and the fourth linear conductor are ¼ or less of the wavelength for the frequency of the high frequency current.

Preferably, the three-dimensional linear conductor includes the first linear conductor, the second linear conductor, the third linear conductor, the fourth linear conductor, and a fifth linear conductor electrically connected to the third linear conductor that are integrally formed, and the fifth linear conductor is provided on the major surface side.

Preferably, the length of the second linear conductor is less than or equal to the length of the planar conductor in the y-axis direction, and the length of the third linear conductor is less than or equal to the length of the planar conductor in the z-axis direction.

Preferably, the three-dimensional linear conductor includes the first linear conductor, the second linear conductor, the third linear conductor, and a sixth linear conductor provided on the opposite side to the major surface of the planar conductor that are integrally formed, the sixth linear conductor is provided such that the sixth linear conductor and the first linear conductor lie on the same line, one end of the sixth linear conductor is electrically connected to the power feed point, and one end of the first linear conductor electrically connected to the power feed point, and one end of the sixth linear conductor electrically connected to the power feed point are electrically connected to each other.

Preferably, a loading coil is inserted in at least one of the first linear conductor, the second linear conductor, and the third linear conductor.

Preferably, at least one of the first linear conductor, the second linear conductor, and the third linear conductor is meander-shaped.

Preferably, at least one of the first linear conductor, the second linear conductor, and the third linear conductor is connected to a loading capacitor.

Preferably, the planar conductor is further provided with a slit.

Preferably, the input impedance of the antenna and the output impedance of the antenna are matched to each other by an external matching circuit.

A radio communication device according to another aspect of the present invention performs radio communication using the antenna.

Advantageous Effects of Invention

The present invention can achieve an antenna that prevents an occurrence of a location on the orthogonal planes in the three-dimensional space, at which the electric field strength is significantly reduced.

DESCRIPTION OF EMBODIMENTS

Hereinafter, embodiments of the present invention are described with reference to the drawings. In the following description, the same components are labeled with the same reference symbols. The names and functions of those components are also the same. For this reason, detailed description of them is not given in some cases.

Embodiment 1

Figure 1:
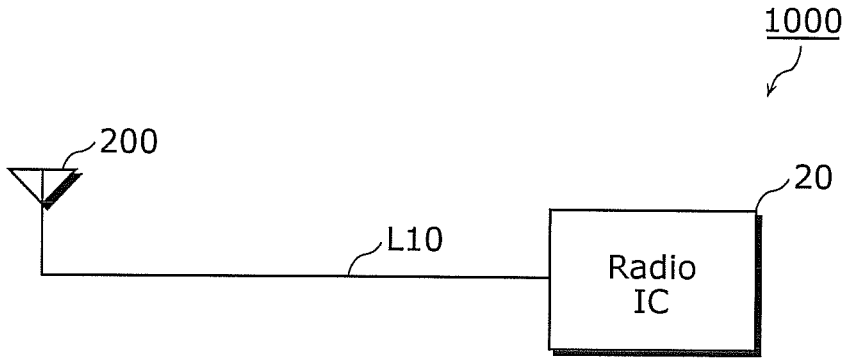
FIG. 1 is a block diagram showing the configuration of a radio communication device in Embodiment 1.

FIG. 1 is a block diagram showing the configuration of a radio communication device 1000 in Embodiment 1.

As shown in FIG. 1, the radio communication device 1000 includes a radio IC (Integrated Circuit) 20, a power feed line L10, and an antenna 200.

The radio IC 20 is electrically connected to the antenna 200 via the power feed line L10, and the detail is described later. The radio IC 20 supplies high frequency current (electric power) used for radio communication to the antenna 200 via the power feed line L10.

Here, the three-dimensional coordinate system in the present description is described.

Figure 2:
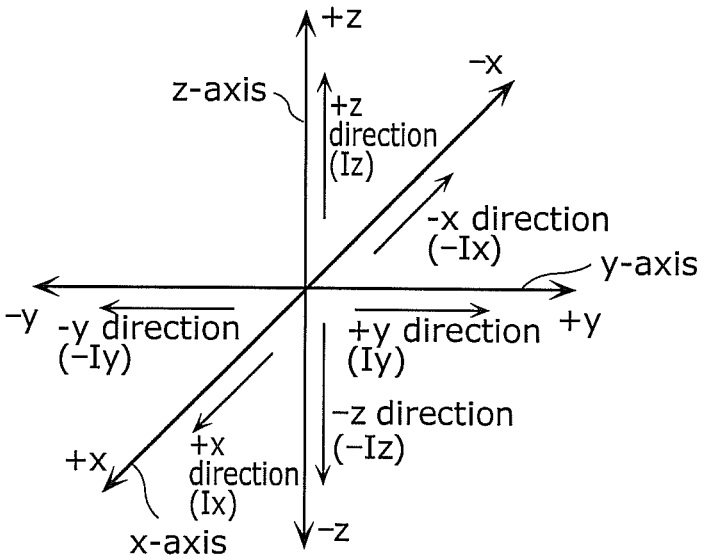
FIG. 2 is an illustration showing a three-dimensional coordinate system.

FIG. 2 is an illustration showing the three-dimensional coordinate system.

As shown in FIG. 2, respective axes of the x-axis, the y-axis, and the z-axis are perpendicular to each other in the three-dimensional coordinate system. Here, +x direction denotes one of two directions along the x-axis, and −x direction denotes the other of the two directions along the x-axis. Also, +y direction denotes one of two directions along the y-axis, and −y direction denotes the other of the two directions along the y-axis. Also, +z direction denotes one of two directions along the z-axis, and −z direction denotes the other of the two directions along the z-axis.

Hereinafter, the plane that includes the x-axis and the y-axis is referred to as the x-y plane. Also, hereinafter, the plane that includes the z-axis and the x-axis is referred to as the z-x plane. Also, hereinafter, the plane that includes the z-axis and the y-axis is referred to as the z-y plane.

Figure 3:
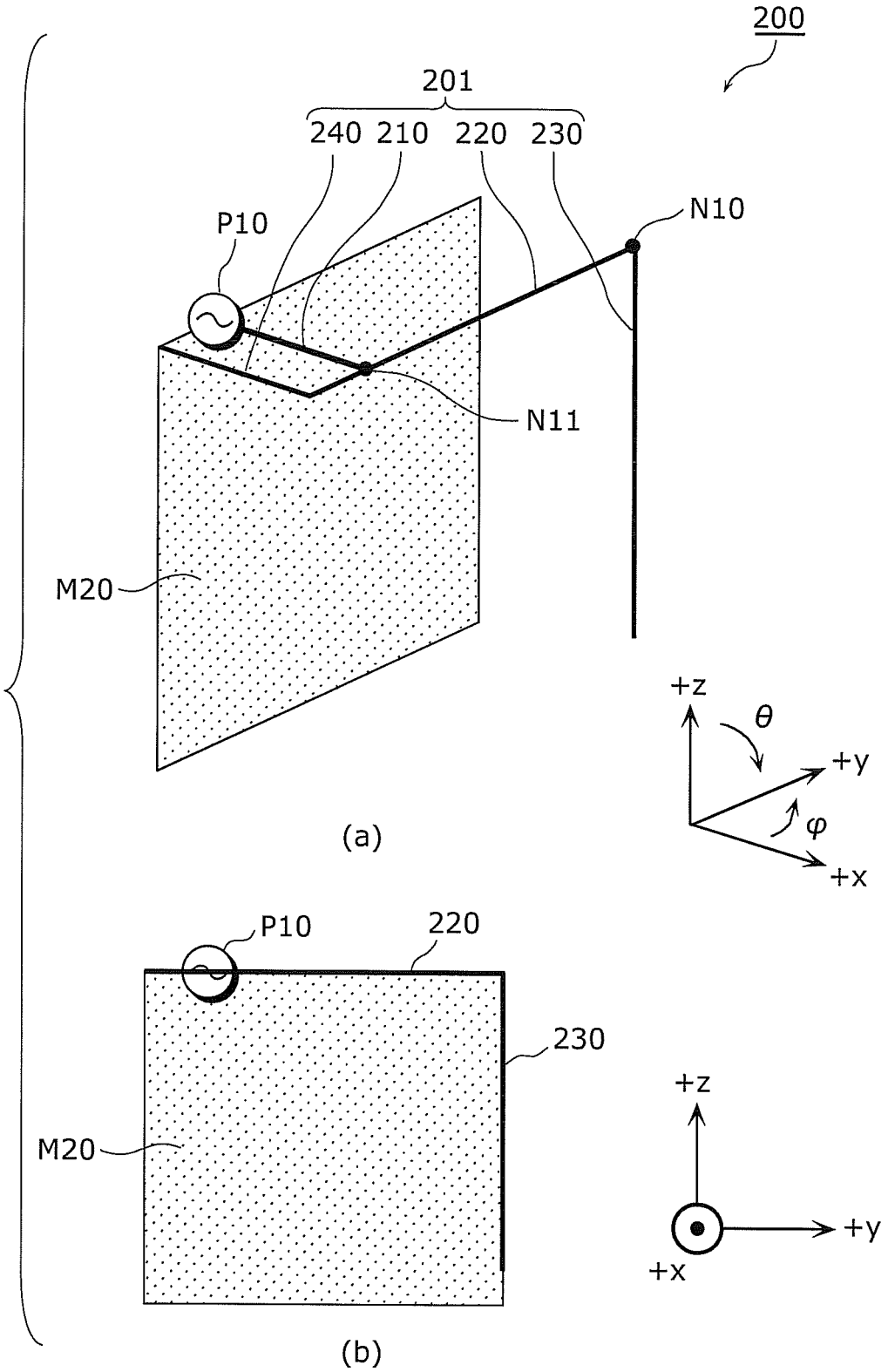
FIG. 3 is an illustration showing the configuration of an antenna in Embodiment 1.

FIG. 3 is an illustration showing the configuration of the antenna 200 in Embodiment 1.

(A) in FIG. 3 is a perspective view of the antenna 200. (B) in FIG. 3 is a view of the antenna 200 projected onto the z-y plane of the three-dimensional coordinate system.

The antenna 200 includes a planar conductor M20 and a three-dimensional linear conductor 201.

The shape of the planar conductor M20 is planar. Specifically, the shape of the planar conductor M20 is quadrilateral. The shape of the planar conductor M20 is not limited to quadrilateral, but may be another shape (for example, hexagonal). The planar conductor M20 is grounded.

Figure 4:
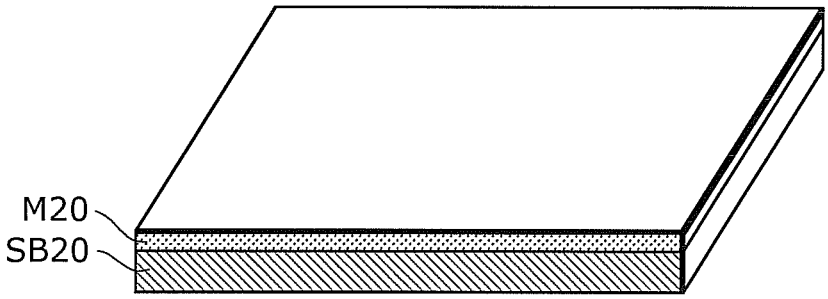
FIG. 4 is an illustration showing the location where a planar conductor is formed.

As shown in FIG. 4, the planar conductor M20 is formed on a substrate SB20.

The plane size of the planar conductor M20 is the same as that of the substrate 5B20. However, the plane size of the planar conductor M20 may be different from that of the substrate SB20.

Referring back to FIG. 3 again, the three-dimensional linear conductor 201 is a linear conductor in which a linear conductor 210, a linear conductor 220, a linear conductor 230, and a linear conductor 240 are integrally formed. The linear conductor 210, the linear conductor 220, the linear conductor 230, and the linear conductor 240 are a first linear conductor, a second linear conductor, a third linear conductor, and a fourth linear conductor, respectively.

Each of the linear conductors 210, 220, 230, 240 is a conductor with a linear shape. However, each of the linear conductors 210, 220, 230, 240 is not limited to be a conductor with a linear shape, but may be a conductor with another shape. Each of the linear conductors 210, 220, 230, 240 is composed of metallic material such as tin or copper.

Each of the linear conductors 210, 220, 230, 240 is provided on the major surface side of the planar conductor M20. The major surface of the planar conductor M20 is a rear surface that is on the opposite side to the surface of the planar conductor M20 of FIG. 4 that is in contact with the substrate SB20.

The linear conductor 210 is provided perpendicularly to the major surface of the plane conductor M20. Each of the linear conductors 220, 230 is parallel to the major surface of the planar conductor M20. The linear conductor 230 is provided perpendicularly to the linear conductor 220. One end of the linear conductor 230 is electrically connected to the linear conductor 220 at a contact point N10. The linear conductor 230 is provided so as to extend in −z direction from the contact point N10.

The length of the linear conductor 240 is the same as that of the linear conductor 210. The linear conductor 240 is parallel to the linear conductor 210.

The length of the linear conductor 220 is equal to or less than that of the planar conductor M20 in the y-axis direction. Also, the length of the linear conductor 230 is equal to or less than that of the planar conductor M20 in the z-axis direction.

The gauges of the linear conductors 210, 220, 230, 240 are almost the same. The respective radii of the linear conductor 220, 230 are supposed to be shorter than the length of the linear conductor 210. That is to say, the respective gauges of the linear conductors 220, 230 have such dimensions that the linear conductors 220, 230 are not in contact with the planar conductor M20.

One end of the linear conductor 240 is electrically connected to the planar conductor M20. As described above, one end of the linear conductor 220 is electrically connected to one end of the linear conductor 230. The other end of the linear conductor 220 is electrically connected to the planar conductor M20 via the linear conductor 240.

Also, as shown in (b) in FIG. 3, the respective linear conductors 220, 230 are disposed perpendicularly above the corresponding ends of the planar conductor M20. The respective linear conductors 220, 230 may be disposed perpendicularly above the interior of the planar conductor M20.

Here, the major surface of the planar conductor M20 is supposed to be parallel to the z-y plane of the three-dimensional coordinate system. In this case, the linear conductors 210, 240 are parallel to the x-axis of the three-dimensional coordinate system. Also, the linear conductor 220 is parallel to the y-axis of the three-dimensional coordinate system. Also, the linear conductor 230 is parallel to the z-axis of the three-dimensional coordinate system.

FIG. 3 shows a power feed region P10 contains a power feed point PT10 which is described later.

Figure 5:
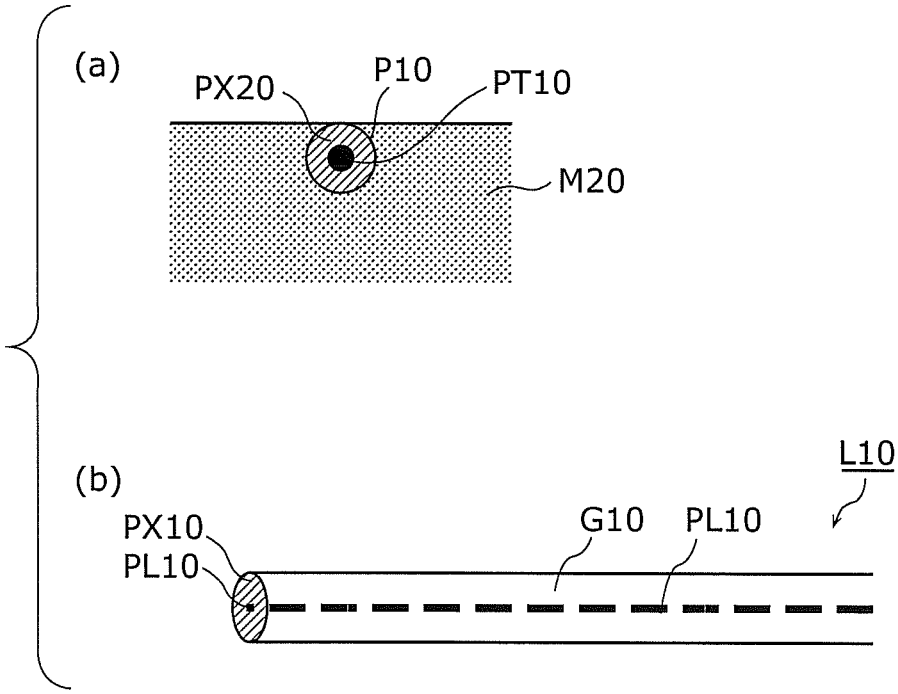
FIG. 5 is an illustration for explaining a power feed region.

FIG. 5 is an illustration for explaining the power feed region P10.

(A) in FIG. 5 is an illustration for showing in detail the configuration around the power feed region P10.

The power feed region P10 is provided on the major surface of the planar conductor M20. The power feed region P10 contains the power feed point PT10. The power feed point PT10 is provided on the major surface of the planar conductor M20. The power feed point PT10 is electrically disconnected to the planar conductor M20 via an insulating film PX20. That is to say, the power feed point PT10 is provided in the planar conductor M20 so as to be disconnected thereto.

The power feed point PT10 is provided in the vicinity of the edge of the planar conductor M20 as shown in FIG. 3. The power feed point PT10 may not be provided in the vicinity of the edge of the planar conductor M20

Here, the detailed configuration of the power feed line L10 is described.

(B) in FIG. 5 is an illustration for showing in detail the configuration of the power feed line L10.

As shown in (b) in FIG. 5, the power feed line L10 contains a power supply line PL10. The power supply line PL10 is a conductive line which transmits a high frequency current. The power supply line PL10 is covered with an insulating film PX10. A ground film G10 is formed on the surface of the insulating film PX10. That is to say, the power supply line PL10 and the ground film G10 are electrically disconnected to each other. Also, the ground film G10 is grounded.

The power feed point PT10 is electrically connected to the power supply line PL10 of the power feed line L10. The boundary of the power feed region P10 provided in the planar conductor M20 is electrically connected to the ground film G10. The power supply line PL10 and the ground film G10 are electrically connected to the radio IC 20.

The radio IC 20 supplies a high frequency current (electric power) used for radio communication to the power feed point PT10 via the power supply line PL10. That is to say, a high frequency current used for radio communication is supplied to the power feed point PT10 from the outside. The power feed point PT10 is electrically connected to one end of the linear conductor 210 of the three-dimensional linear conductor 201.

Accordingly, the high frequency current supplied to the power feed point PT10 flows through the three-dimensional linear conductor 201. In this case, radio waves are emitted from the antenna 200 that includes the three-dimensional linear conductor 201. The planar conductor M20 is effectively used to emit the radio waves.

That is to say, the radio IC 20 performs radio communication using the antenna 200. In other words, the radio communication device 1000 performs radio communication using the antenna 200.

Also, a high frequency current flows through the three-dimensional linear conductor 201, so that a current flows through the planar conductor M20 to the power feed point PT10.

When the three-dimensional linear conductor 201 receives a radio wave from the outside, the radio wave is converted to a high frequency current, which flows through the radio IC 20 via the power feed point PT10 and the power supply line PL10.

Also, the other end of the linear conductor 210 is electrically connected to a contact point N11 of the linear conductor 220.

The length of the planar conductor M20 in the z-axis direction is ¼ or less of the wavelength λ of the frequency of the high frequency current that is used for radio communication. Also, each of the lengths of the linear conductors 210, 220, 230, 240 is ¼ or less of the wavelength λ for the frequency of the high frequency current that is used for radio communication.

Here, the following are defined in a state where a high frequency current which is supplied to the power feed point PT10 flows through the three-dimensional linear conductor 201 to emit a radio wave from the antenna 200.

The major surface of the planar conductor M20 is defined to be parallel to the z-y plane of the three-dimensional coordinate system of FIG. 2. Also, Lx denotes the length of the three-dimensional linear conductor 201 in the x-axis direction. That is to say, Lx denotes the length of each of the linear conductors 210, 240. Also, Ly denotes the length of the three-dimensional linear conductor 201 in the y-axis direction. That is to say, Ly denotes the length of the linear conductor 220. Also, Lz2 denotes the length of the three-dimensional linear conductor 201 in the z-axis direction. That is to say, Lz2 denotes the length of the linear conductor 230. Also, Lz1 denotes the length of the planar conductor M20 in the z-axis direction.

Furthermore, Ix denotes a current flowing along the x-axis out of the high frequency current flowing through the three-dimensional linear conductor 201 where Ix is represented by a positive value when the current flows in the +x direction, Iy denotes a current flowing along the y-axis out of the high frequency current flowing through the three-dimensional linear conductor 201 where Iy is represented by a positive value when the current flows in the +y direction, Iz1 denotes a current flowing along a z-axis out of the current flowing through the planar conductor M20 where Iz1 is represented by a positive value when the current flows in the +z direction, Iz2 denotes a current flowing along the z-axis out of the high frequency current flowing through the three-dimensional linear conductor 201 where Iz2 is represented by a positive value when the current flows in the +z direction.

Also, an electromagnetic moment Mx is defined as Ix×Lx. Also, an electromagnetic moment My is defined as Iy×Ly. An electromagnetic moment Mz is defined as Iz1×Lz1−Iz2×Lz2.

In this case, a current Ix1 flows in the +x direction through the linear conductor 210. Also, in this case, a current Ix2 flows in the −x direction through the linear conductor 240. The current Ix is calculated as Ix1+(−Ix2).

Also, in this case, a current Iy1 flows from the contact point N11 in the +y direction through the linear conductor 220. Also, in this case, a current Iy2 flows from the contact point N11 in the −y direction through the linear conductor 220. The current Iy is calculated as Iy1+(−Iy2).

Also, in this case, a current Iz2 flows in the −z direction through the linear conductor 230. That is to say, the current flowing through the linear conductor 230 is expressed by −Iz2 where the +z direction is assumed to be positive direction.

The inventors formulated a hypothesis (hereinafter referred to as a hypothesis A) that by satisfying the following Expression (1) regarding the electromagnetic moments Mx, My, Mz, it is possible to achieve an antenna that prevents an occurrence of a location (null point) in all directions in the three-dimensional space, where the electric field strength is significantly reduced.

$$Mx=My=Mz \qquad \text{Expression (1)}$$

The electromagnetic moments Mx, My, and Mz are defined by the following Expressions (2), (3), and (4), respectively.

$$Mx=Ix\times Lx \qquad \text{Expression (2)}$$

$$My=Iy\times Ly \qquad \text{Expression (3)}$$

$$Mz=IZ1\times Lz1-Iz2\times Lz2 \qquad \text{Expression (4)}$$

In other words, the inventors formulated the hypothesis A that by designing the size and shape of an antenna so that all the electromagnetic moments Mx, My, and Mz are equal, it is possible to achieve an antenna that prevents an occurrence of a location (null point) in all directions on each of the orthogonal planes in the three-dimensional space, where the electric field strength is significantly reduced. Here, the orthogonal planes are the x-y plane, the z-y plane, and the z-x plane. In order to prove the validity of the hypothesis A, a simulation was performed using an electromagnetic field simulator which is operated by a computer.

Here, the antenna to be simulated is the antenna 200 of FIG. 3. The condition (hereinafter referred to as a condition A) for the simulation is as follows:

Each of the linear conductors 210, 240 has a length of 15 mm. The linear conductor 220 has a length of 40 mm. The linear conductor 230 has a length of 38 mm. The planar conductor M20 has a length of 40 mm in the y-axis and the z-axis directions. The frequency of the high frequency current supplied to the power feed point PT10 is 950 MHz.

Hereinafter, a simulation which is performed under the condition A is referred to as the simulation A.

Figure 6:
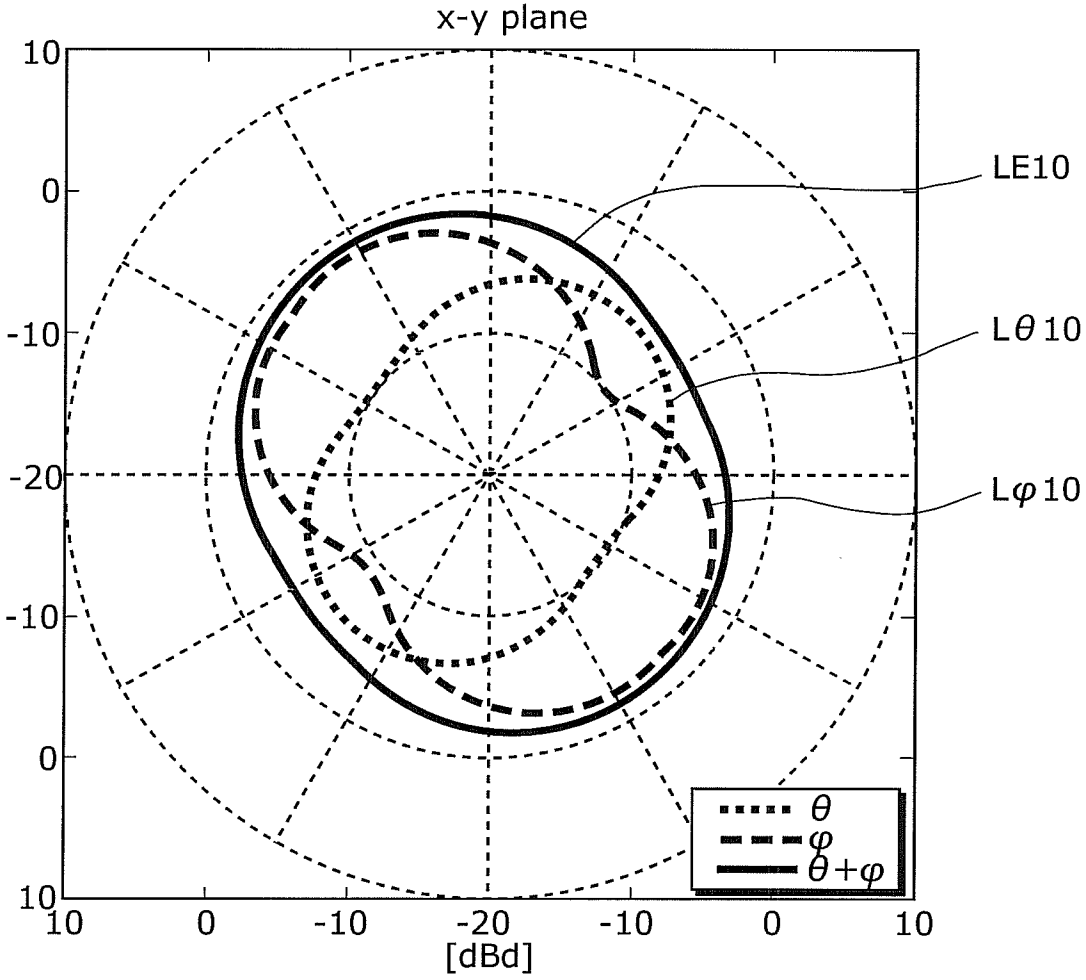
FIG. 6 is a graph showing the emission characteristic of the electric field emitted from the antenna, as indicated by simulation A.

FIG. 6 is a graph showing the emission characteristic of the electric field emitted from the antenna, as indicated by the simulation A.

The emission characteristic of the electric field of FIG. 6 is the emission characteristic of the electric field in the x-y plane.

Hereinafter, the electric field is denoted by E. Also, hereinafter, θ-component of the electric field E is denoted by Eθ. Here, θ is the angle formed by the z-axis and the electric field direction as shown in FIG. 3. Also, hereinafter, Φ-component of the electric field E is denoted by EΦ. Here, Φ is the angle formed by the x-axis and the electric field direction as shown in FIG. 3.

The characteristic line Lθ10 shows the emission characteristic of the electric field Eθ in the x-y plane. The characteristic line LΦ10 shows the emission characteristic of the electric field EΦ in the x-y plane. The characteristic line LE10 shows the emission characteristic of the electric field E in the x-y plane. The electric field E is the composite electric field of the electric field Eθ and the electric field EΦ. The electric field E is a value calculated by the following Expression (5).

[Math. 1]

$$E=\sqrt{|E\Phi|^2+|E\theta|^2} \qquad \text{Expression (5)}$$

Figure 7:
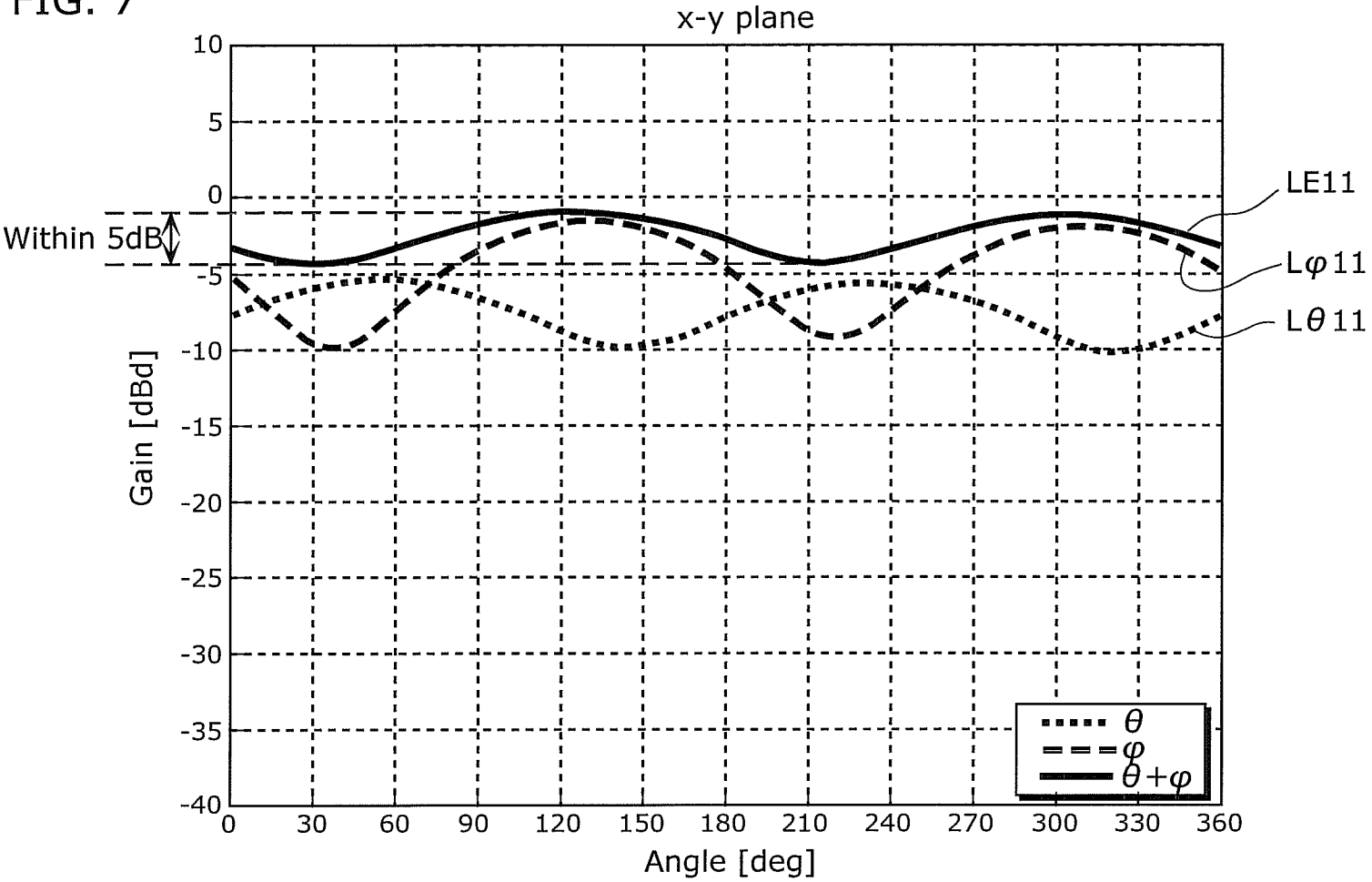
FIG. 7 is a graph showing the emission characteristic of each electric field.

FIG. 7 is a graph showing the emission characteristic of each electric field shown in FIG. 6. In FIG. 7, the vertical axis shows the amplitude (gain) of each characteristic line, and the horizontal axis shows an angle.

The characteristic lines LE11, Lθ11, and LΦ11 of FIG. 7 correspond to the characteristic lines LE10, Lθ10, and LΦ10, respectively.

The difference between the maximum and minimum values of the amplitude (gain) of the characteristic line LE11 of FIG. 7 is equal to or less than 5 dB.

That is to say, based on the result in FIGS. 6 and 7, it can be safely said that there is not a point (null point) in all directions on the x-y plane, at which the strength of the electric field emitted from the antenna is significantly reduced.

Figure 8:
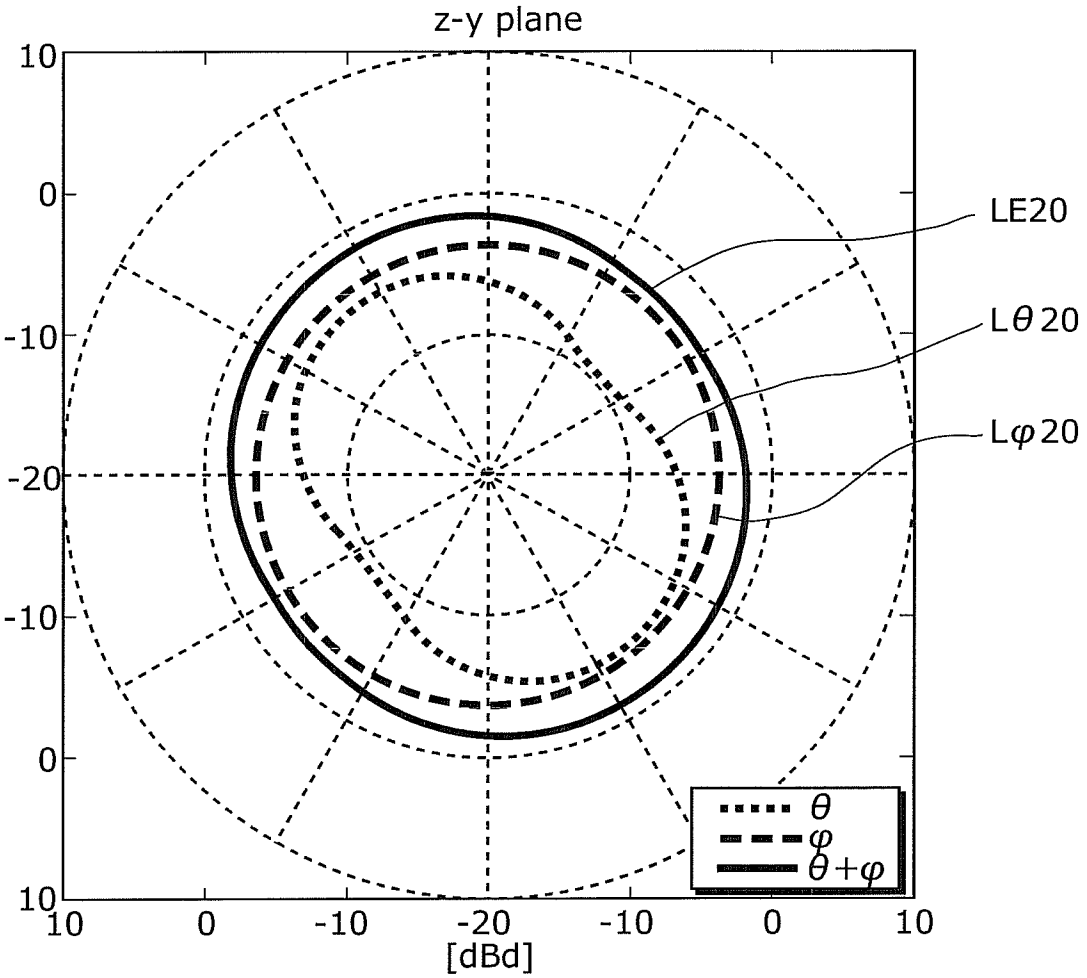
FIG. 8 is a graph showing the emission characteristic of the electric field emitted from the antenna, as indicated by the simulation A.

FIG. 8 is a graph showing the emission characteristic of the electric field emitted from the antenna, as indicated by the simulation A.

The emission characteristic of the electric field in FIG. 8 is the emission characteristic of the electric field in the z-y plane.

The characteristic line Lθ20 shows the emission characteristic of the electric field EA in the z-y plane. The characteristic line LΦ20 shows the emission characteristic of the electric field EΦ in the z-y plane. The characteristic line LE20 shows the emission characteristic of the electric field E in the z-y plane. The electric field E is the composite electric field of the electric field Eθ and the electric field EΦ.

Figure 9:
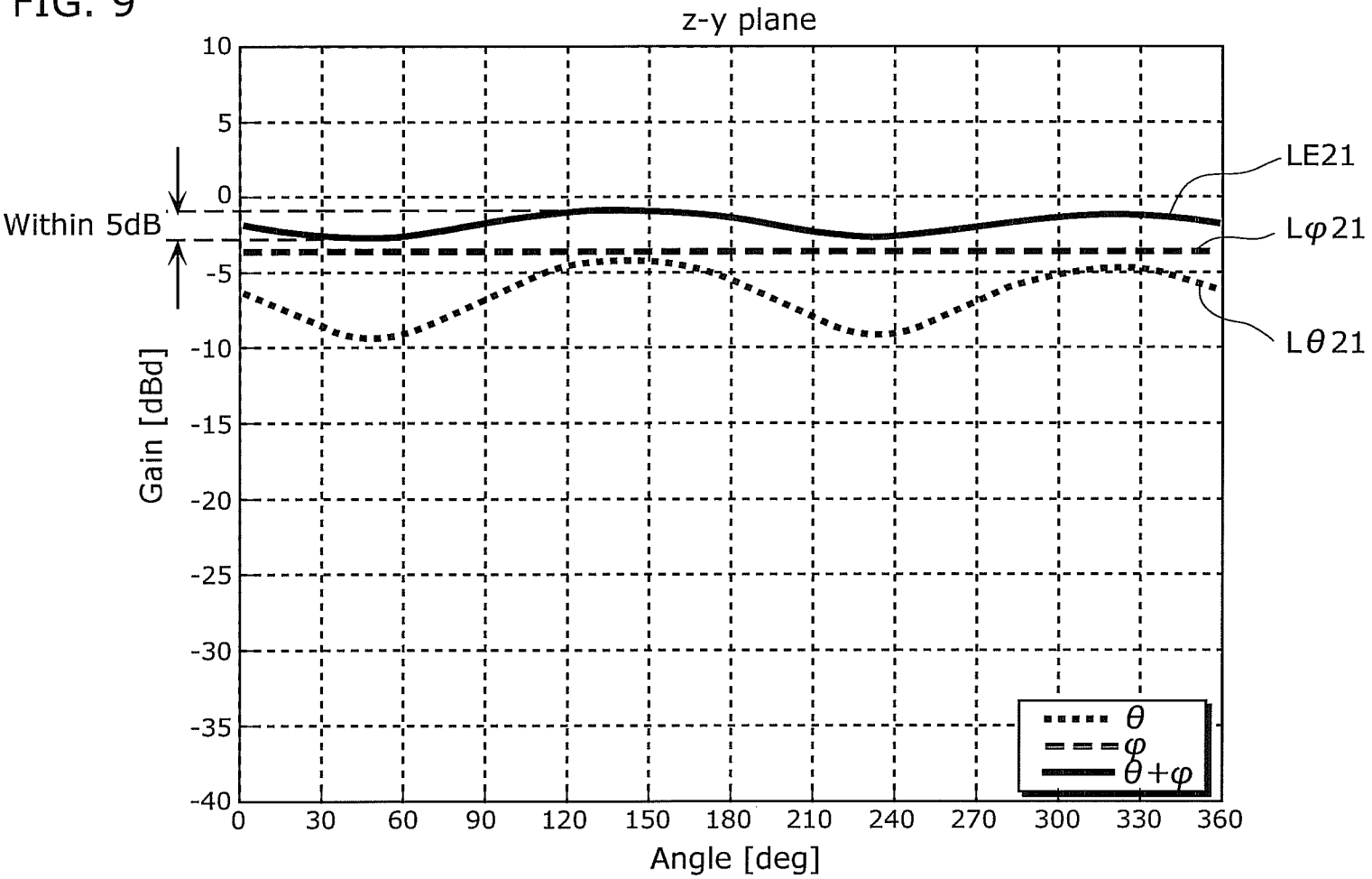
FIG. 9 is a graph showing the emission characteristic of each electric field.

FIG. 9 is a graph showing the emission characteristic of each electric field shown in FIG. 8. The vertical axis and the horizontal axis are the same as those in FIG. 7.

The characteristic lines LE21, Lθ21, and LΦ21 of FIG. 9 correspond to the characteristic lines LE20, Lθ20, and LΦ20, respectively.

The difference between the maximum and minimum values of the amplitude (gain) of the characteristic line LE21 of FIG. 9 is equal to or less than 5 dB.

That is to say, based on the result in FIGS. 8 and 9, it can be safely said that there is not a point (null point) in all directions on the z-y plane, at which the strength of the electric field emitted from the antenna is significantly reduced.

Figure 10:
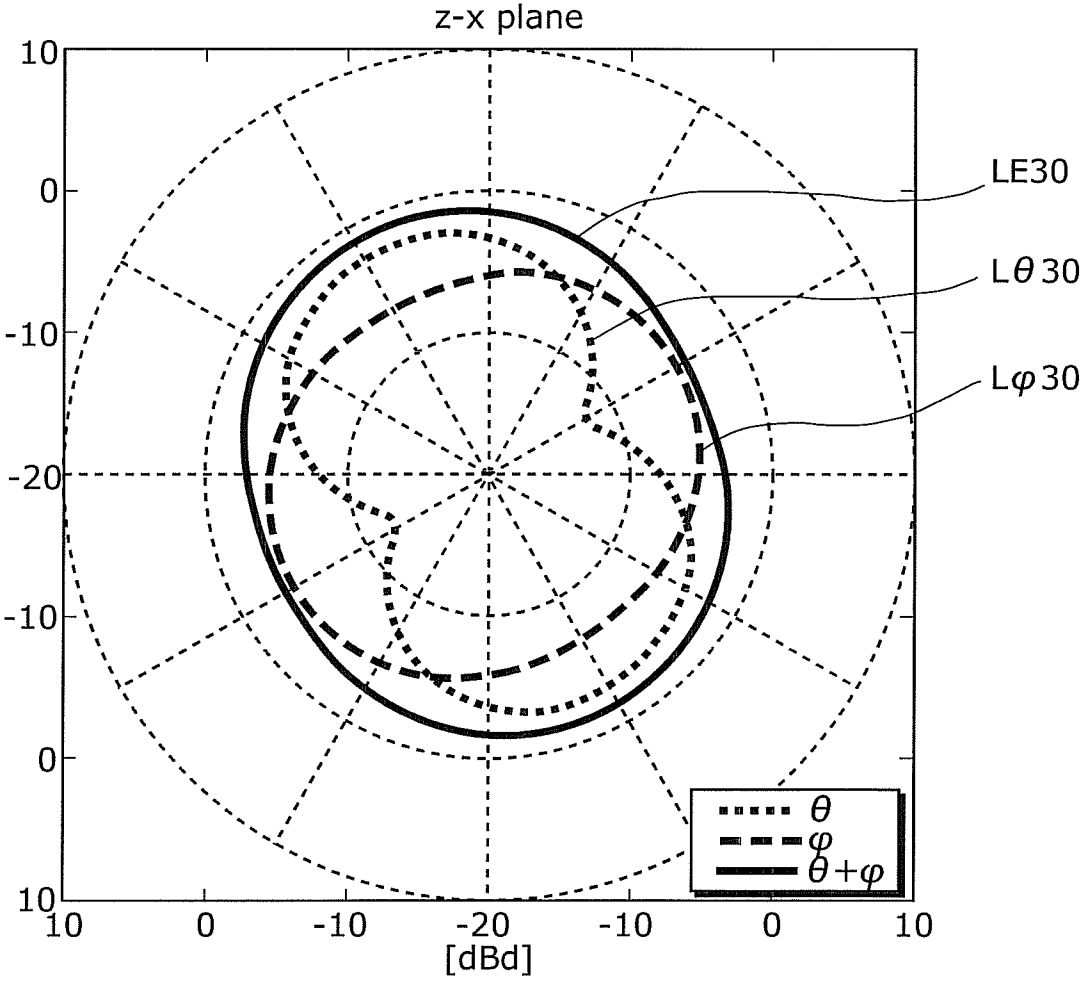
FIG. 10 is a graph showing the emission characteristic of the electric field emitted from the antenna, as indicated by the simulation A.

FIG. 10 is a graph showing the emission characteristic of the electric field emitted from the antenna, as indicated by the simulation A.

The emission characteristic of the electric field in FIG. 10 is the emission characteristic of the electric field in the z-x plane.

The characteristic line Lθ30 shows the emission characteristic of the electric field Eθ in the z-x plane. The characteristic line LΦ30 shows the emission characteristic of the electric field EΦ in the z-x plane.

The characteristic line LE30 shows the emission characteristic of the electric field E in the z-x plane. The electric field E is the composite electric field of the electric field Eθ and the electric field E.

Figure 11:
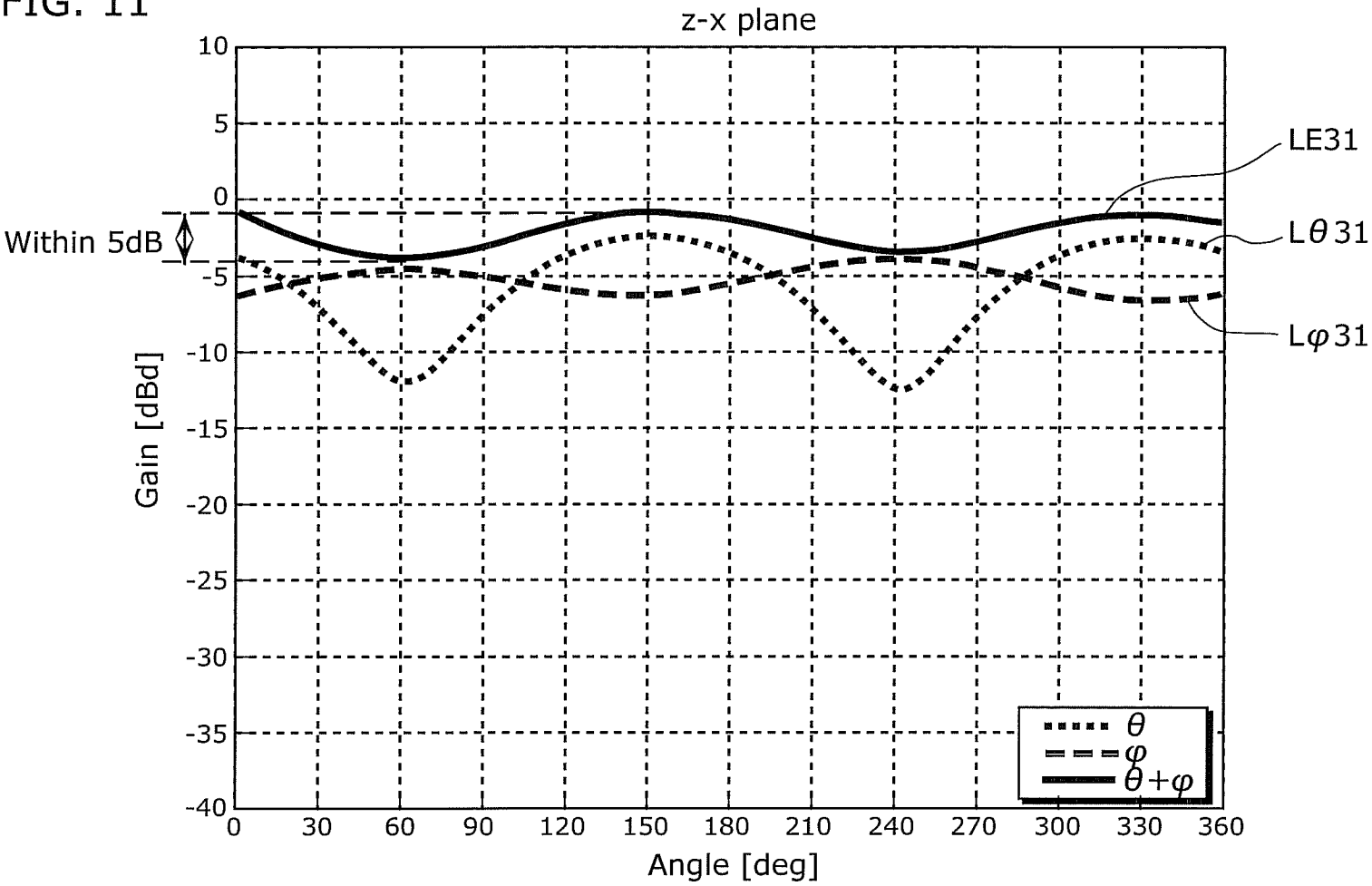
FIG. 11 is a graph showing the emission characteristic of each electric field.

FIG. 11 is a graph showing the emission characteristic of each electric field shown in FIG. 10. The vertical axis and the horizontal axis are the same as those in FIG. 7.

The characteristic lines LE31, Lθ31, and LΦ31 of FIG. 11 correspond to the characteristic lines LE30, Lθ30, and LΦ30, respectively.

The difference between the maximum and minimum values of the amplitude (gain) of the characteristic line LE31 of FIG. 11 is equal to or less than 5 dB.

That is to say, based on the result in FIGS. 10 and 11, it can be safely said that there is not a point (null point) in all directions on the z-x plane, at which the strength of the electric field emitted from the antenna is significantly reduced.

Next, the result of a simulation is described where the simulation is performed for an antenna as a comparison target (hereinafter, referred to as an antenna for comparison) by using an electromagnetic field simulator, which does not satisfy the relationship of Expression (1).

Hereinafter, a simulation which is performed for the antenna for comparison is referred to as the simulation J. The condition (hereinafter referred to as the condition J) for the simulation J differs from the above-described condition A only in that the planar conductor M20 has a length of 70 mm in the z-axis direction. Except this, the condition J is the same as the condition A.

Figure 12:
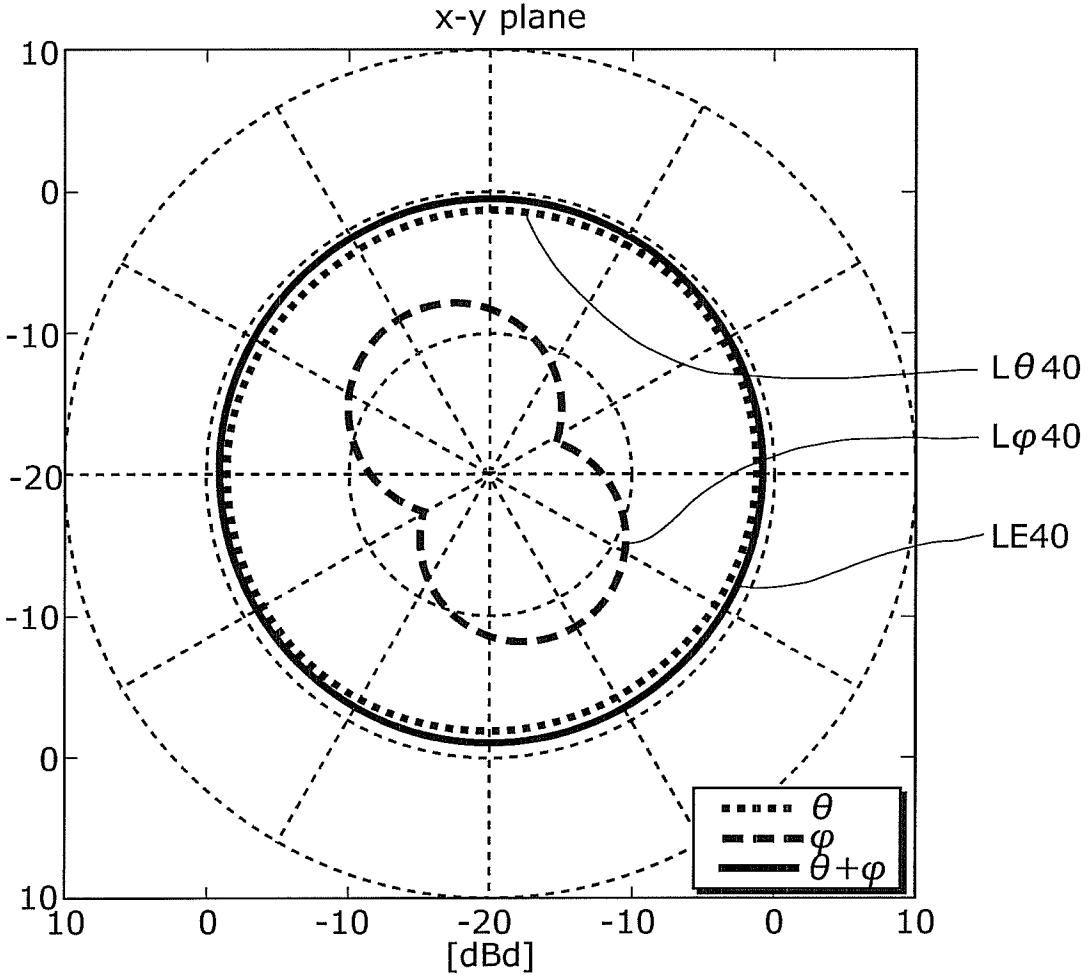
FIG. 12 is a graph showing the emission characteristic of the electric field emitted from the antenna, as indicated by simulation J.

FIG. 12 is a graph showing the emission characteristic of the electric field emitted from the antenna, as indicated by simulation J.

The emission characteristic of the electric field in FIG. 12 is the emission characteristic of the electric field in the x-y plane.

The characteristic line Lθ40 shows the emission characteristic of the electric field Eθ in the x-y plane. The characteristic line LΦ40 shows the emission characteristic of the electric field EΦ in the x-y plane. The characteristic line LE40 shows the emission characteristic of the electric field E in the x-y plane. The electric field E is the composite electric field of the electric field Eθ and the electric field EΦ.

Figure 13:
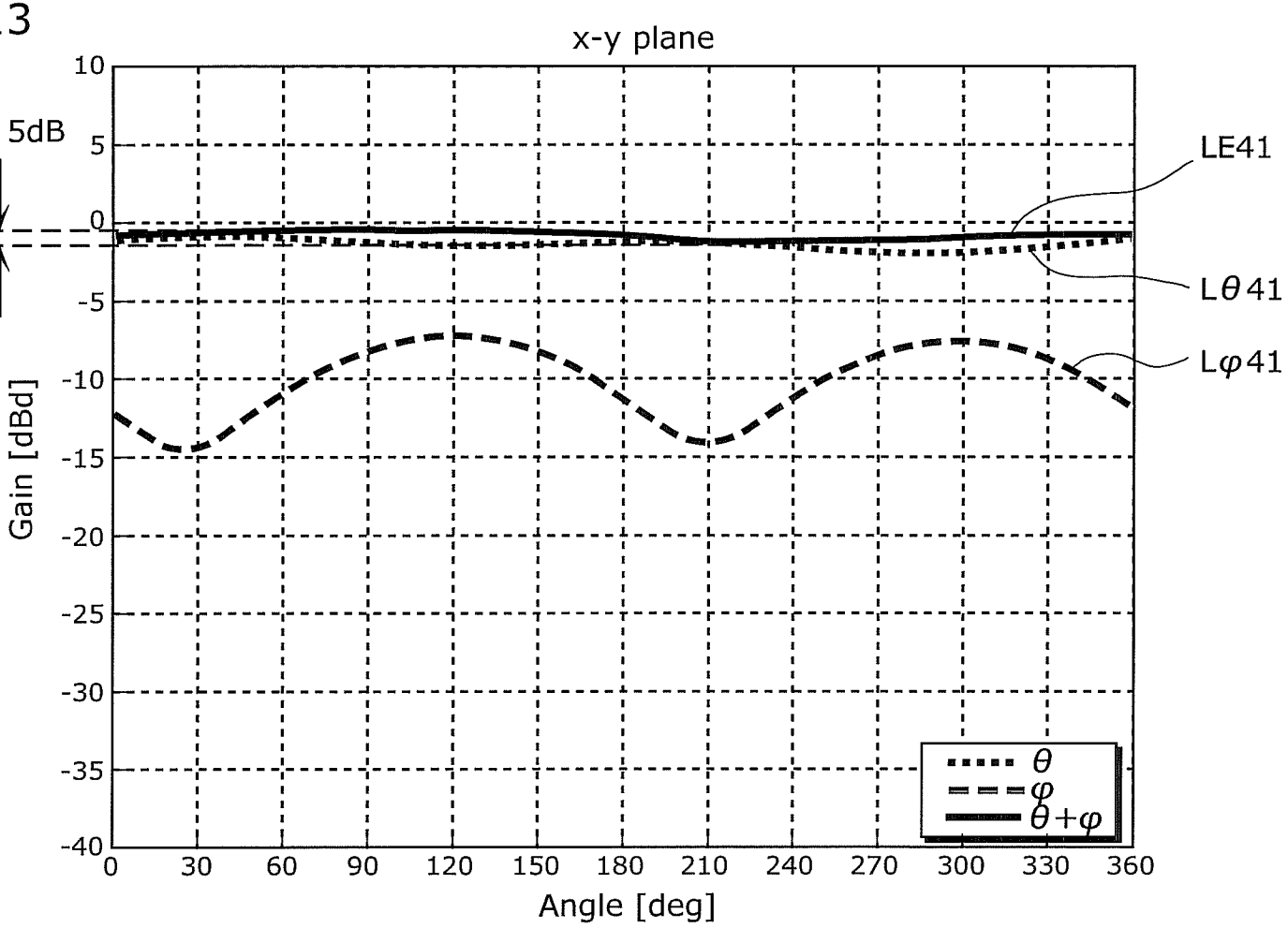
FIG. 13 is a graph showing the emission characteristic of each electric field.

FIG. 13 is a graph showing the emission characteristic of each electric field shown in FIG. 12. The vertical axis and the horizontal axis are the same as those in FIG. 7.

The characteristic lines LE41, Lθ41, and LΦ41 of FIG. 13 correspond to the characteristic lines LE40, Lθ40, and LΦ40, respectively.

The difference between the maximum and minimum values of the amplitude (gain) of the characteristic line LE41 of FIG. 13 is equal to or less than 5 dB.

That is to say, based on the result in FIGS. 12 and 13, it can be safely said that there is not a point (null point) in all directions on the x-y plane, at which the strength of the electric field emitted from the antenna is significantly reduced.

Figure 14:
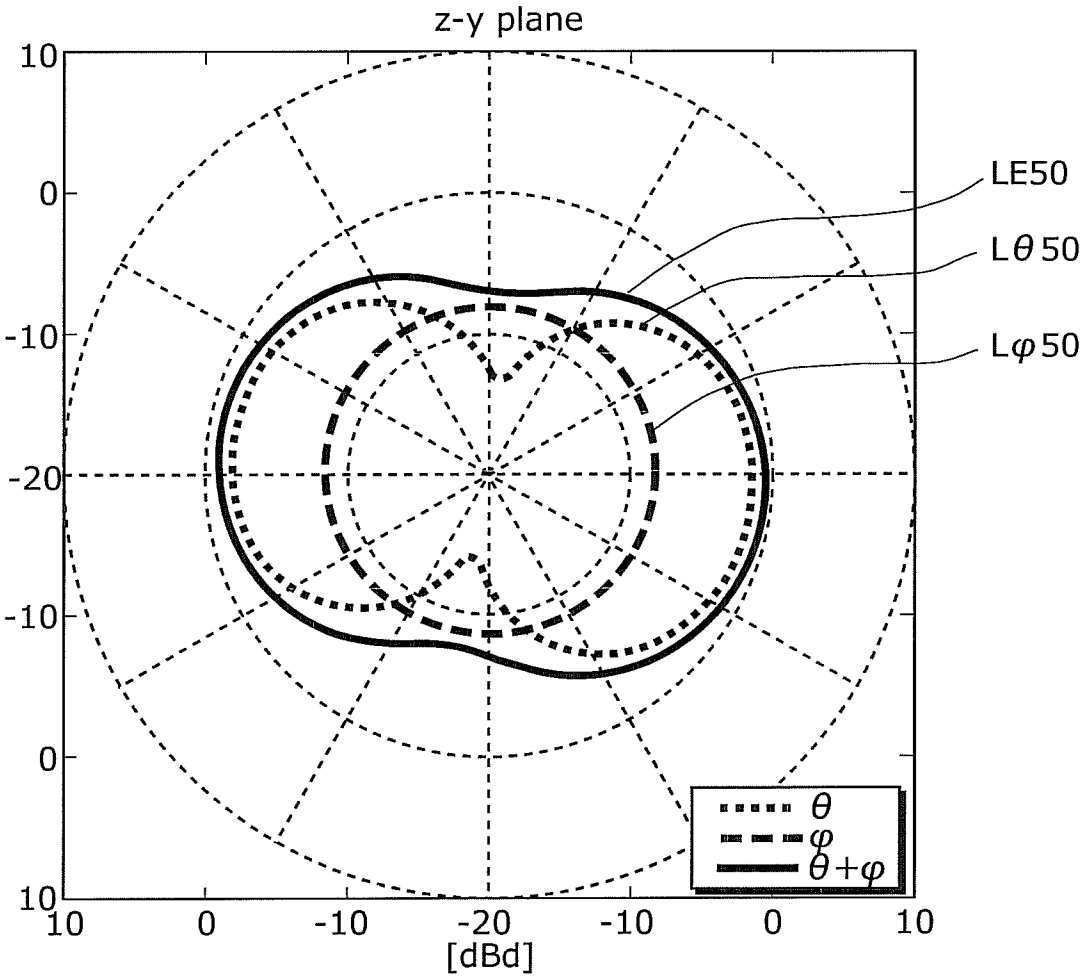
FIG. 14 is a graph showing the emission characteristic of the electric field emitted from the antenna, as indicated by the simulation J.

FIG. 14 is a graph showing the emission characteristic of the electric field emitted from the antenna, as indicated by the simulation J.

The emission characteristic of the electric field in FIG. 14 is the emission characteristic of the electric field in the z-y plane.

The characteristic line Lθ50 shows the emission characteristic of the electric field EA in the z-y plane. The characteristic line LΦ50 shows the emission characteristic of the electric field EΦ in the z-y plane. The characteristic line LE50 shows the emission characteristic of the electric field E in the z-y plane. The electric field E is the composite electric field of the electric field Eθ and the electric field EΦ.

Figure 15:
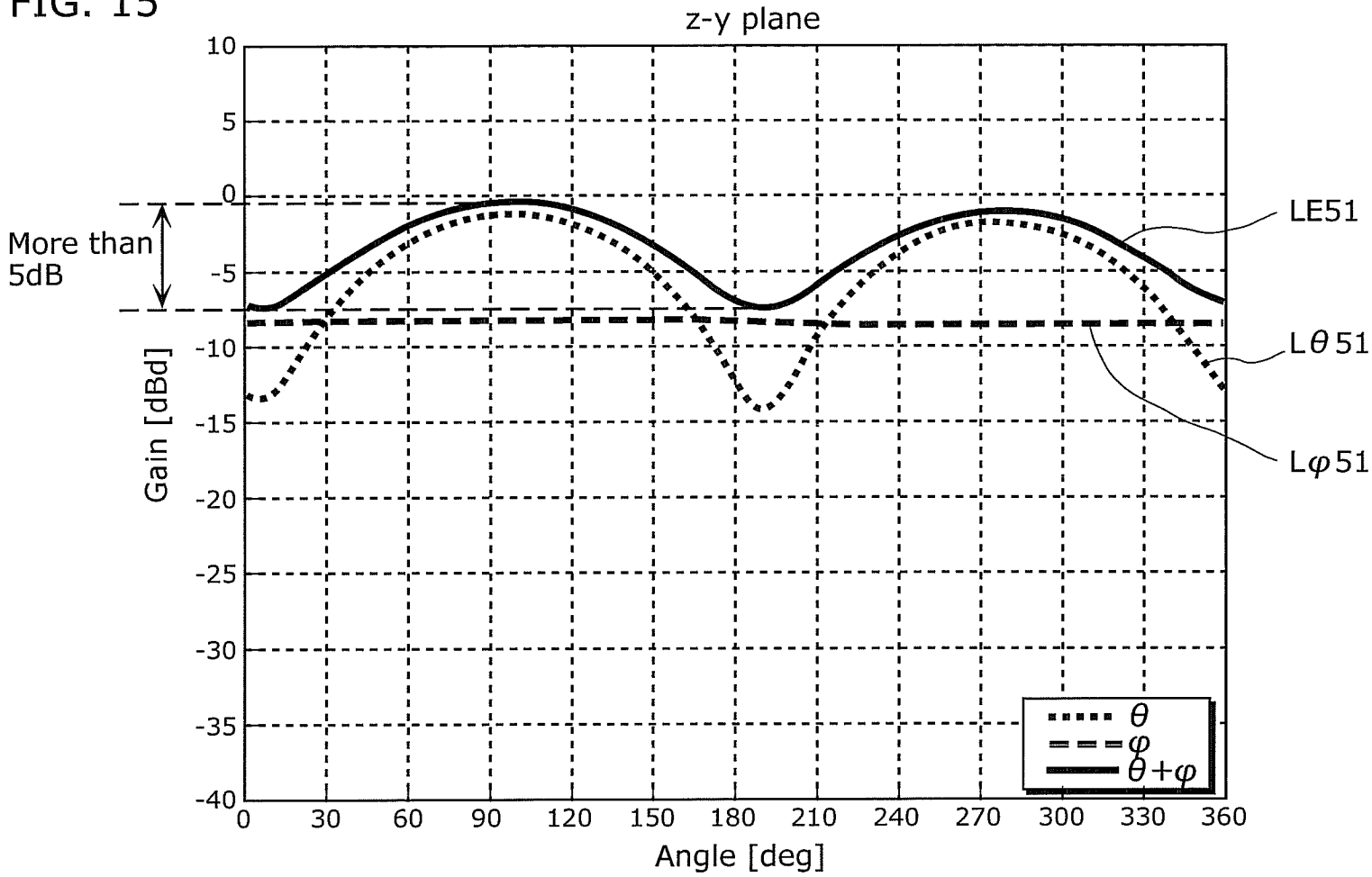
FIG. 15 is a graph showing the emission characteristic of each electric field.

FIG. 15 is a graph showing the emission characteristic of each electric field shown in FIG. 14. The vertical axis and the horizontal axis are the same as those in FIG. 7.

The characteristic lines LE51, Lθ51, and LΦ51 of FIG. 15 correspond to the characteristic lines LE50, Lθ50, and LΦ50, respectively.

The difference between the maximum and minimum values of the amplitude (gain) of the characteristic line LE51 of FIG. 15 is greater than 5 dB.

That is to say, based on the result in FIGS. 14 and 15, it can be safely said that there exists a point (null point) on the z-y plane, at which the strength of the electric field emitted from the antenna is significantly reduced.

Figure 16:
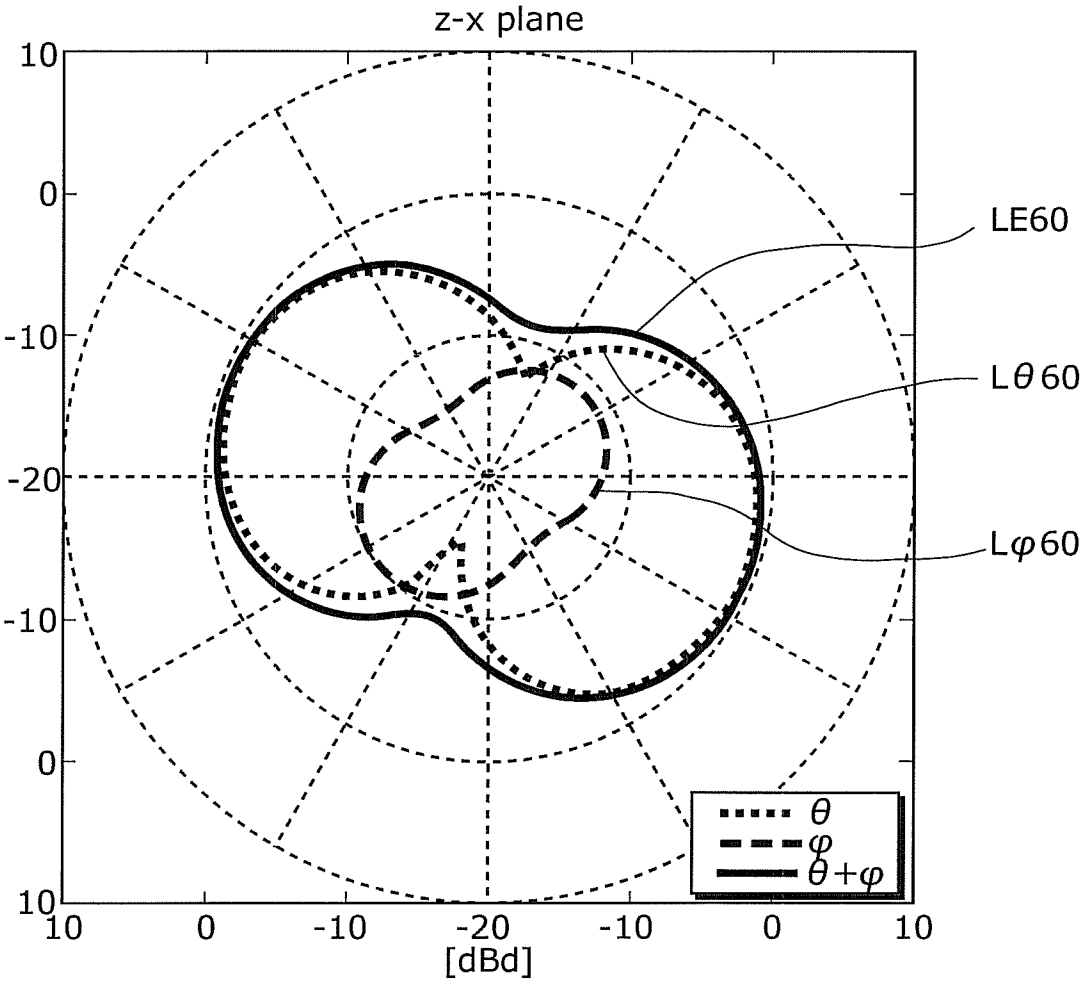
FIG. 16 is a graph showing the emission characteristic of the electric field emitted from the antenna, as indicated by the simulation J.

FIG. 16 is a graph showing the emission characteristic of the electric field emitted from the antenna, as indicated by the simulation J.

The emission characteristic of the electric field in FIG. 16 is the emission characteristic of the electric field in the z-x plane.

The characteristic line Lθ60 shows the emission characteristic of the electric field Eθ in the z-x plane. The characteristic line LΦ60 shows the emission characteristic of the electric field EΦ in the z-x plane. The characteristic line LE60 shows the emission characteristic of the electric field E in the z-x plane. The electric field E is the composite electric field of the electric field Eθ and the electric field EΦ.

Figure 17:
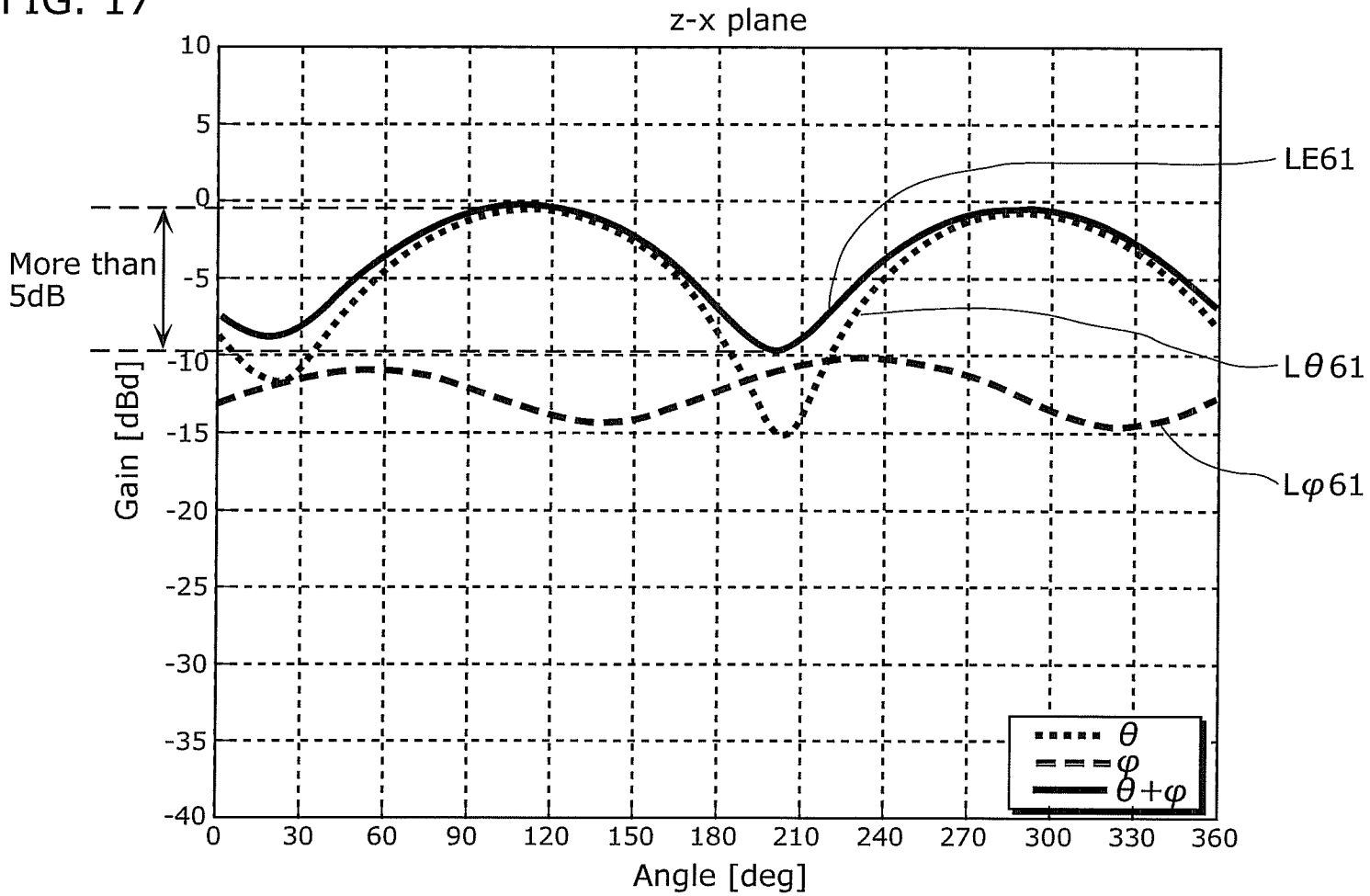
FIG. 17 is a graph showing the emission characteristic of each electric field.

FIG. 17 is a graph showing the emission characteristic of each electric field shown in FIG. 16. The vertical axis and the horizontal axis are the same as those in FIG. 7.

The characteristic lines LE61, Lθ61, and LΦ61 of FIG. 17 correspond to the characteristic lines LE60, Lθ60, and LΦ60, respectively.

The difference between the maximum and minimum values of the amplitude (gain) of the characteristic line LE61 of FIG. 17 is greater than 5 dB.

That is to say, based on the result in FIGS. 16 and 17, it can be safely said that there exists a point (null point) on the z-x plane, at which the strength of the electric field emitted from the antenna is significantly reduced.

From the result of the above simulation, it can be inferred that by designing the size and shape of an antenna so that all the electromagnetic moments Mx, My, and Mz are equal, it is possible to achieve an antenna that prevents an occurrence of a location (null point) in all directions on each of the orthogonal planes in the three-dimensional space, where the electric field strength is significantly reduced.

The inventors produced a prototype of an antenna (hereinafter, referred to as a prototype antenna A) which satisfies Expression (1) and the above-described condition A, and measured the emission characteristic of the actual electric field. The prototype antenna A is the antenna 200 of FIG. 3.

Figure 18:
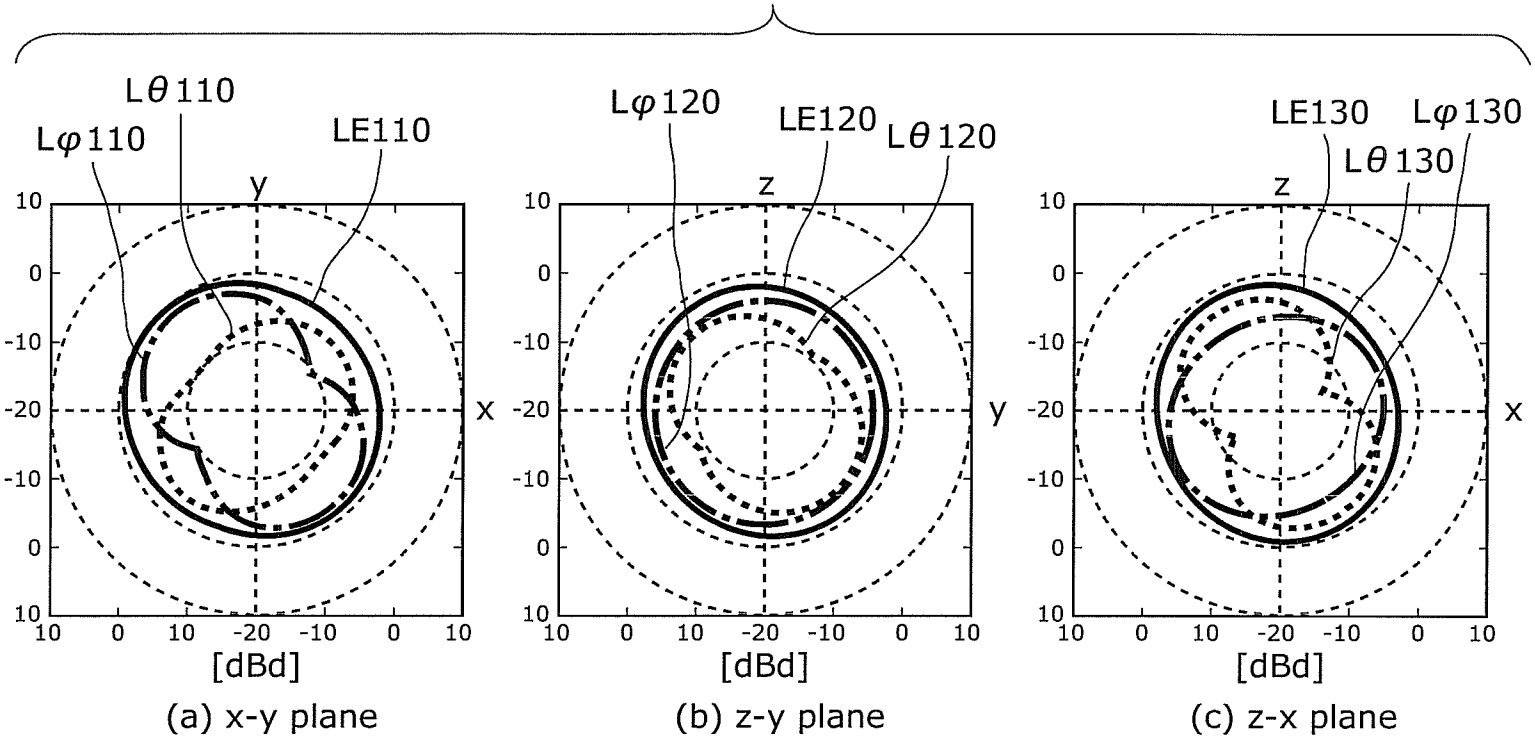
FIG. 18 is a graph showing the emission characteristic of each electric field.

FIG. 18 is a graph showing the emission characteristic of the electric field emitted from the prototype antenna A.

The emission characteristic of the electric field in (a) in FIG. 18 is the emission characteristic of the electric field in the x-y plane.

The characteristic line Lθ110 shows the emission characteristic of the electric field EA in the x-y plane. The characteristic line LΦ110 shows the emission characteristic of the electric field EΦ in the x-y plane. The characteristic line LE110 shows the emission characteristic of the electric field E in the x-y plane. The electric field E is the composite electric field of the electric field Eθ and the electric field EΦ.

The shape of the characteristic line LE110 is substantially a circle. That is to say, from (a) in FIG. 18, it can be safely said that there is not a point (null point) in all directions on the x-y plane, at which the strength of the electric field emitted from the prototype antenna A is significantly reduced.

The emission characteristic of the electric field in (b) in FIG. 18 is the emission characteristic of the electric field in the z-y plane.

The characteristic line Lθ120 shows the emission characteristic of the electric field Eθ in the z-y plane. The characteristic line LΦ120 shows the emission characteristic of the electric field Eθ in the z-y plane. The characteristic line LE120 shows the emission characteristic of the electric field E in the z-y plane. The electric field E is the composite electric field of the electric field Eθ and the electric field EΦ.

The shape of the characteristic line LE120 is substantially a circle. That is to say, from (b) in FIG. 18, it can be safely said that there is not a point (null point) in all directions on the z-y plane, at which the strength of the electric field emitted from the prototype antenna A is significantly reduced.

The emission characteristic of the electric field in (c) in FIG. 18 is the emission characteristic of the electric field in the z-x plane.

The characteristic line Lθ130 shows the emission characteristic of the electric field Eθ in the z-x plane. The characteristic line LΦ130 shows the emission characteristic of the electric field EΦ in the z-x plane.

The characteristic line LE130 shows the emission characteristic of the electric field E in the z-x plane. The electric field E is the composite electric field of the electric field Eθ and the electric field EΦ.

The shape of the characteristic line LE130 is substantially a circle. That is to say, from (c) in FIG. 18, it can be safely said that there is not a point (null point) in all directions on the z-x plane, at which the strength of the electric field emitted from the prototype antenna A is significantly reduced.

In addition, the inventors produced an antenna (hereinafter, referred to as a comparison antenna 900) which does not satisfy Expression (1), and measured the emission characteristic of the actual electric field. The comparison antenna 900 is an antenna that is formed so as to satisfy the above-described condition J.

Figure 19:
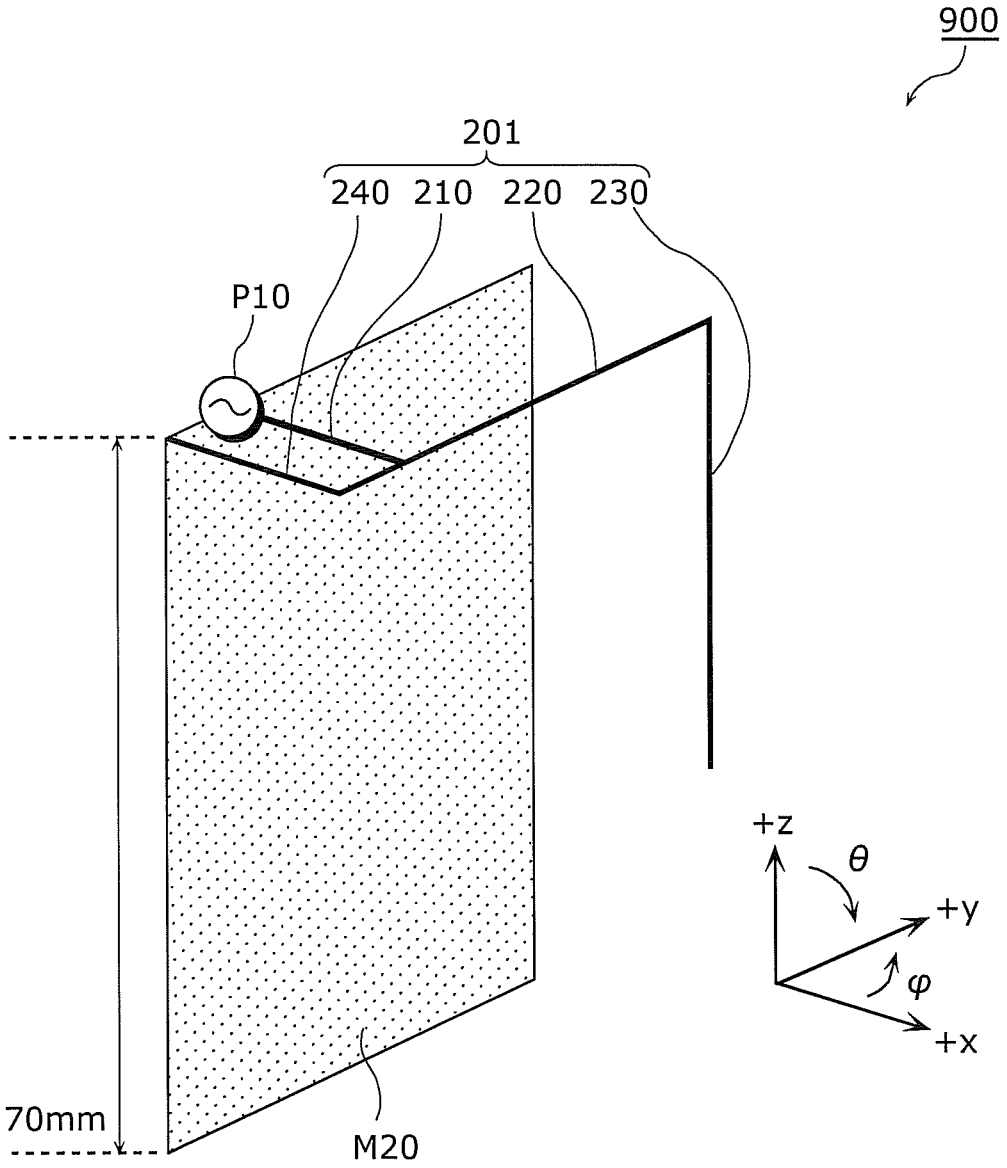
FIG. 19 is an illustration showing the configuration of another antenna for comparison.

FIG. 19 is an illustration showing the configuration of the comparison antenna 900.

As shown in FIG. 19, compared with the antenna of FIG. 3, the comparison antenna 900 has a different length of the planar conductor M20 in the z-axis direction. Except for this difference, the configuration of the comparison antenna 900 is the same as that of the antenna 200, thus detailed description is not repeated. The length Lz1 of the planar conductor M20 in the z-axis direction is, for example, 70 mm.

When Lz1 is 70 mm, i.e., Lz1 is increased, the electromagnetic moment Mz becomes greater than the electromagnetic moments Mx, My as seen from Expression (4). Consequently, Expression (1) is not satisfied. That is to say, in the comparison antenna 900, the electromagnetic moments Mx, My, and Mz do not have the same value.

Figure 20:
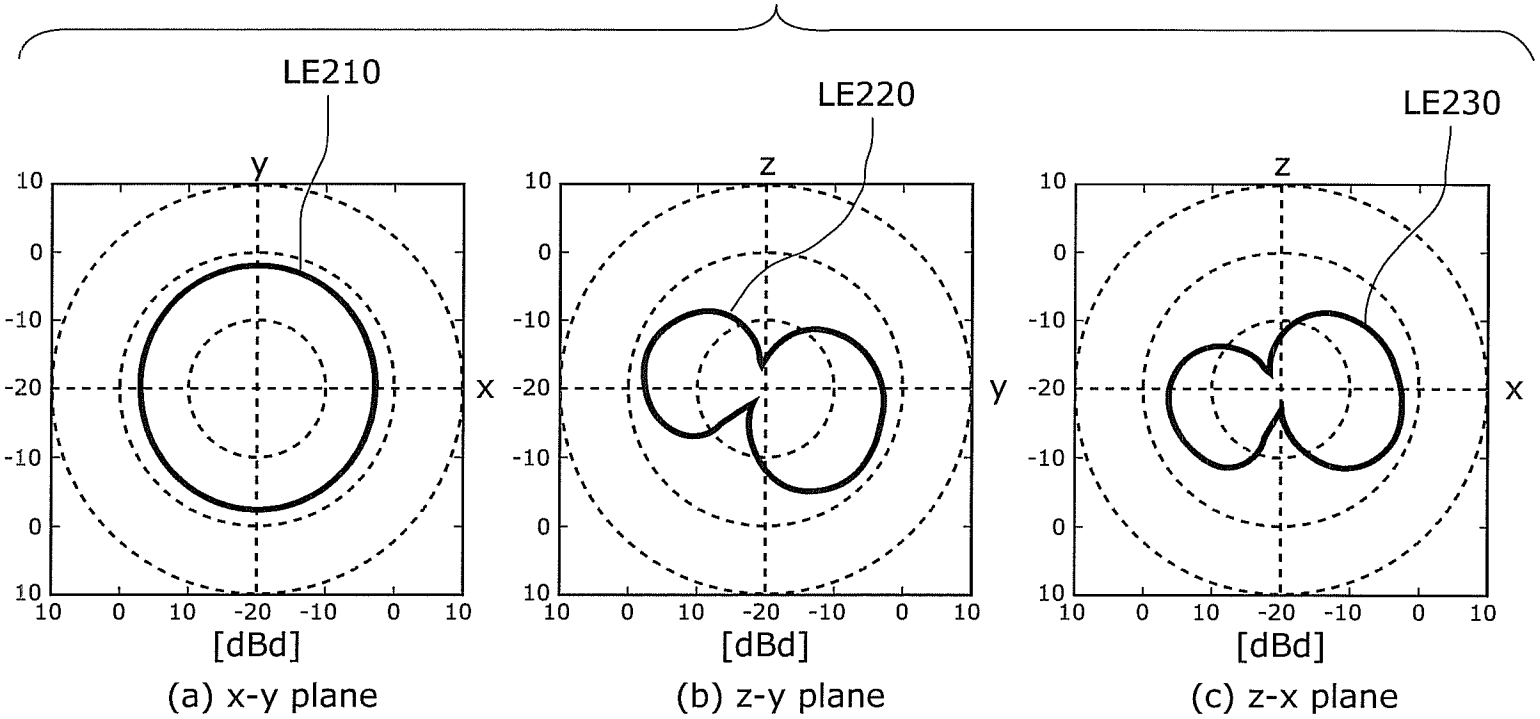
FIG. 20 is a graph showing the emission characteristic of each electric field.

FIG. 20 is a graph showing the emission characteristic of the electric field emitted from the comparison antenna 900.

The emission characteristic of the electric field in (a) in FIG. 20 is the emission characteristic of the electric field in the x-y plane. The characteristic line LE210 shows the emission characteristic of the electric field E in the x-y plane.

The shape of the characteristic line LE210 is substantially a circle. That is to say, from (a) in FIG. 20, it can be safely said that there is not a point (null point) in all directions on the x-y plane, at which the strength of the electric field emitted from the comparison antenna 900 is significantly reduced.

The emission characteristic of the electric field in (b) in FIG. 20 is the emission characteristic of the electric field in the z-y plane.

From (b) in FIG. 20, it can be safely said that there exists a point (null point) on the z-y plane, at which the strength of the electric field emitted from the antenna is significantly reduced.

The emission characteristic of the electric field in (c) in FIG. 20 is the emission characteristic of the electric field in the z-x plane.

From FIG. 20, it can be safely said that there exists a point (null point) on the z-x plane, at which the strength of the electric field emitted from the antenna is significantly reduced.

That is to say, from FIG. 18, the prototype antenna A which satisfies Expression (1) and the above-described condition A serves to prevent an occurrence of a location (null point) in all directions on the orthogonal planes in the three-dimensional space, where the electric field strength is significantly reduced. In other words, the antenna designed to have equal electromagnetic moments of Mx, My, and Mz serves to prevent an occurrence of a location (null point) in all directions on the orthogonal planes in the three-dimensional space, where the electric field strength is significantly reduced. Therefore, the validity of the above-mentioned hypothesis A has been proved.

Thus, the antenna 200 in the present embodiment serves to prevent an occurrence of a location (null point) in all directions on the orthogonal planes in the three-dimensional space, where the electric field strength is significantly reduced. That is to say, the antenna 200 serves to prevent an occurrence of a location (null point) in all directions on the orthogonal planes in the three-dimensional space, where the electric field strength is significantly reduced. In other words, the antenna 200 has a small variation in its directivity on each of the orthogonal planes in the three-dimensional space.

Therefore, the radio communication device 1000 equipped with the antenna 200 can perform stable communication regardless of where or which direction the radio communication device 1000 is installed on a human body or at a location away from a human body.

That is to say, the radio communication device 1000 equipped with the antenna 200 can perform stable communication regardless of the install location, direction, or movement of a human body. That is to say, the antenna 200 is particularly effective when communication is performed among a plurality of radio communication devices attached to human bodies while the antenna 200 is used for each radio communication device.

In addition, the antenna 200 is particularly effective when communication is performed between a radio communication device attached to a human body and another radio communication device away from the human body while the antenna 200 is used for each radio communication device.

In addition, because the planar conductor M20 is advantageously utilized for the emission of radio waves (electric field), the radio communication device 1000 equipped with the antenna 200 can be reduced in size.

In the three-dimensional linear conductor 201 of FIG. 3, a portion closer to the power feed point PT10 has more current flowing through the portion. Accordingly, the length of the conductor in relation to each electromagnetic moment can be reduced. On the other hand, in the three-dimensional linear conductor 201, a portion far from the power feed point PT10 (for example, the linear conductor 230) has less current flowing therethrough than a portion near the power feed point PT10 (for example, the linear conductor 210).

The distance between the linear conductor 210 and the linear conductor 240 is preferably such that the input impedance of the antenna 200 is 50Ω for the frequency of the high frequency current which flows through the antenna 200 and is used for radio communication. The input impedance of the antenna 200 is the impedance as the antenna 200 is viewed from the power feed point PT10.

However, in most cases, the input impedance of the antenna 200 is not set to 50Ω because of the effect of the shape or the like of the antenna 200. Thus, a matching circuit (not shown) is used. Impedance matching is performed by the matching circuit so that the input impedance of the antenna 200 is set to 50Ω. The matching circuit is included in the radio communication device 1000.

As described above, the power feed point PT10 is provided in the vicinity of the edge of the planar conductor M20. Consequently, the lengths of the linear conductor 220 and the linear conductor 230 can be effectively secured. Accordingly, the radio communication device 1000 equipped with the antenna 200 can be reduced in size.

Also, as described above, the length of the planar conductor M20 in the z-axis direction and the respective lengths of the linear conductors 210, 220, 230, 240 are ¼ or less of the wavelength λ for the frequency of the high frequency current that is used for radio communication.

The antenna 200 excites the high frequency current with the wavelength λ centered on the power feed point PT10. When the length of the planar conductor M20 in the z-axis direction and the respective lengths of the linear conductors 210, 220, 230, 240 become λ/4 or more, a positive and a negative amplitudes occur simultaneously on the planar conductor M20. Accordingly, degradation of the emission characteristic is caused.

For this reason, the length of the planar conductor M20 in the z-axis direction and the respective lengths of the linear conductors 210, 220, 230, 240 are set to λ/4 or less. Accordingly, degradation of the emission characteristic of the antenna 200 can be prevented and the performance of the antenna 200 can be improved.

Although the linear conductor 230 of FIG. 3 has been assumed to be provided so as to extend from the contact point N10 in the −z direction, however this is not always the case. The linear conductor 230 may be provided so as to extend from the contact point N10 in the +z direction like an antenna 200A shown in (a) and (b) in FIG. 21.

Figure 21:
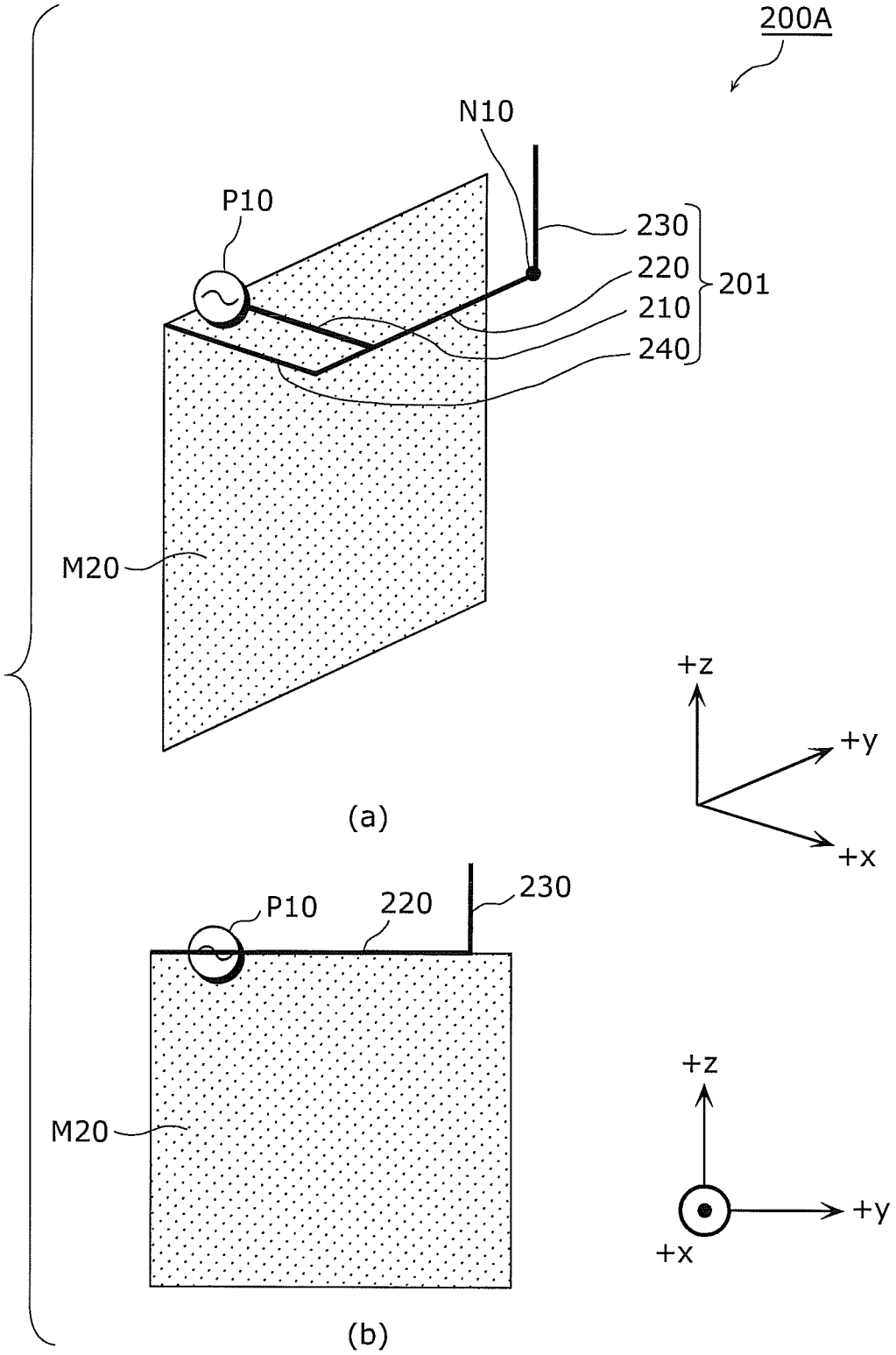
FIG. 21 is an illustration showing the configuration of an antenna.

(A) in FIG. 21 is a perspective view of the antenna 200A. (B) in FIG. 21 is a view of the antenna 200A projected onto the z-y plane of the three-dimensional coordinate system. Also in the antenna 200A, similarly to what has been described above, the size and shape of each component are defined so that the electromagnetic moments Mx, My, and Mz are equal.

In this case, a current flows through the linear conductor 230 in the +z direction. The current is denoted by Iz2.

In this case, the electromagnetic moment Mz is expressed by the following Expression (6).

$$Mz = Iz1 \times Lz1 + Iz2 \times Lz2 \qquad \text{Expression (6)}$$

From Expressions (4) and (6), it can be seen that the value of the electromagnetic moment Mz in the antenna 200A is greater than that of the electromagnetic moment Mz in the antenna 200. In this case, the length of the planar conductor M20 in the z-axis direction of the antenna 200A can be made shorter than that of the antenna 200.

Figure 22:
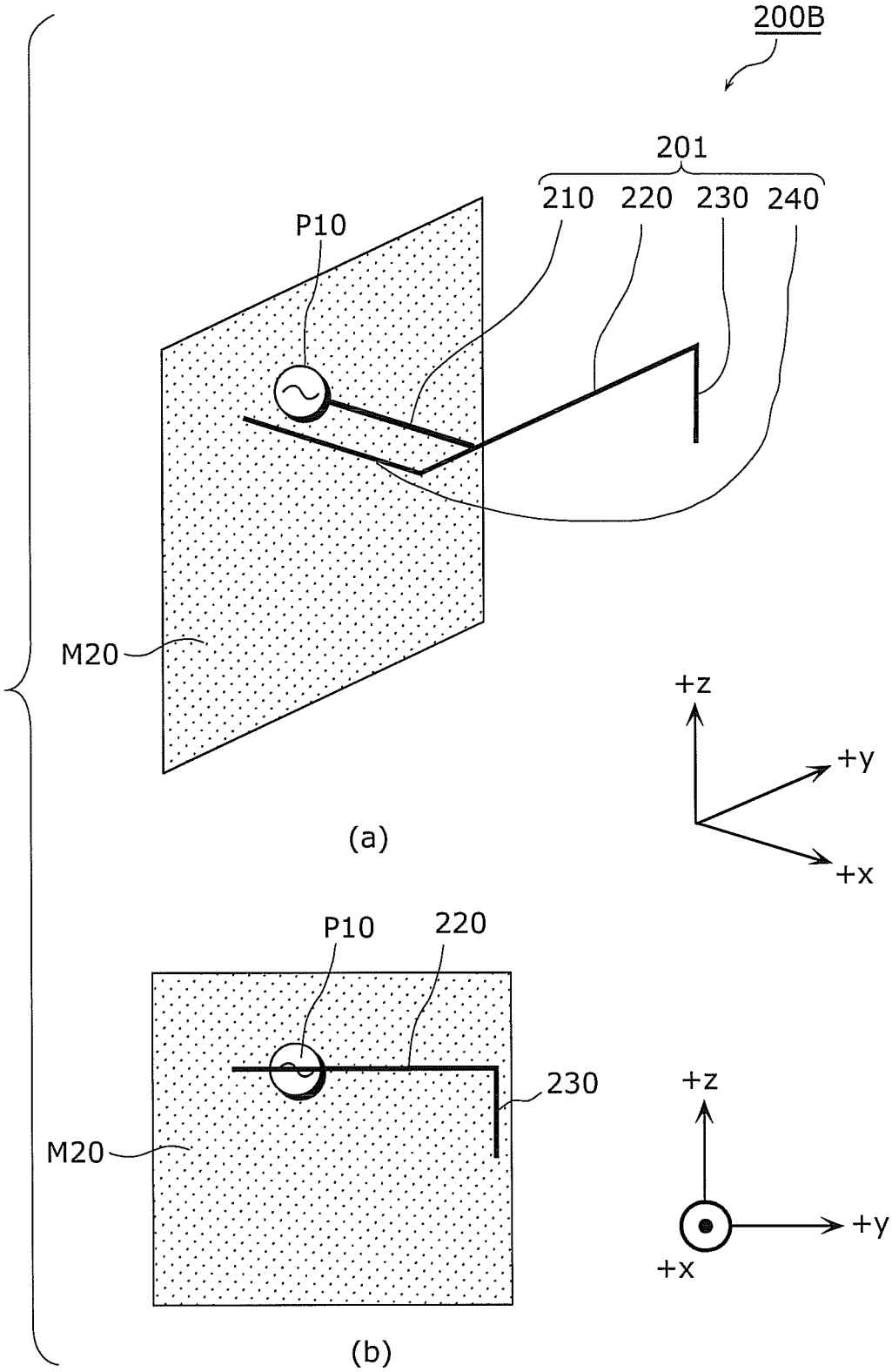
FIG. 22 is an illustration showing the configuration of another antenna.

Also, as described above, the power feed point PT10 does not need to be provided in the vicinity of the edge of the planar conductor M20. For example, the power feed point PT10 may be disposed near the center of the planar conductor M20 like the antenna 200B of FIG. 22. (A) in FIG. 22 is a perspective view of the antenna 200B. (B) in FIG. 22 is a view of the antenna 200B projected onto the z-y plane of the three-dimensional coordinate system.

Also in the antenna 200B, similarly to what has been described above, the size and shape of each component are defined so that the electromagnetic moments Mx, My, and Mz are equal.

Modification 1 of Embodiment 1

The radio communication device 1000 in Modification 1 of the present embodiment includes an antenna 200C instead of the antenna 200. Except for this, the configuration of the radio communication device 1000 is the same as that of the radio communication device 1000 of FIG. 1, thus detailed description is not repeated.

Figure 23:
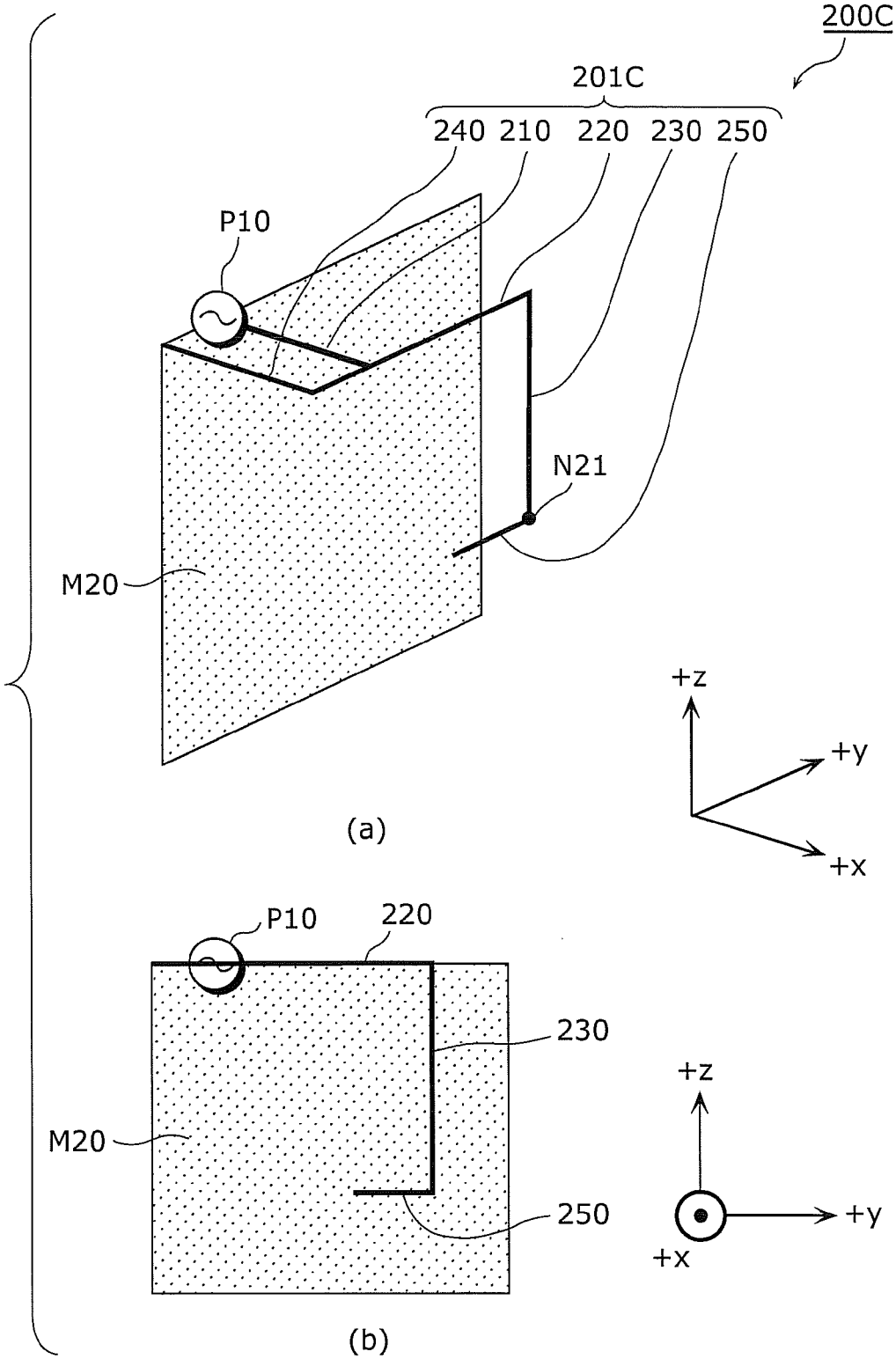
FIG. 23 is an illustration showing the configuration of an antenna in Modification 1 of Embodiment 1.

FIG. 23 is an illustration showing the configuration of the antenna 200C in Modification 1 of Embodiment 1.

(A) in FIG. 23 is a perspective view of the antenna 200C. (B) in FIG. 23 is a view of the antenna 200C projected onto the z-y plane of the three-dimensional coordinate system.

As shown in FIG. 23, the antenna 200C differs from the antenna 200 in that the antenna 200C includes a three-dimensional linear conductor 201C instead of the three-dimensional linear conductor 201. Except for this, the configuration of the antenna 200C is the same as that of the antenna 200, thus detailed description is not repeated.

The three-dimensional linear conductor 201C differs from the three-dimensional linear conductor 201 of FIG. 3 in that the three-dimensional linear conductor 201C further includes a linear conductor 250.

The three-dimensional linear conductor 201C is a linear conductor in which the linear conductor 210, the linear conductor 220, the linear conductor 230, the linear conductor 240, and the linear conductor 250 are integrally formed. The linear conductor 250 is a fifth linear conductor.

The linear conductor 250 is a conductor with a linear shape. The linear conductor 250 is not limited to be a conductor with a linear shape, but may be a conductor with another shape. The linear conductor 250 is provided on the major surface side of the planar conductor M20.

One end of the linear conductor 250 is electrically connected to the linear conductor 230 at a contact point N21. The linear conductor 250 is provided so as to extend in the −y direction from the contact point N21.

Also, the linear conductor 250 may be provided so as to extend in any one of the +y direction, the −z direction, and ±x direction from the contact point N21.

Figure 24:
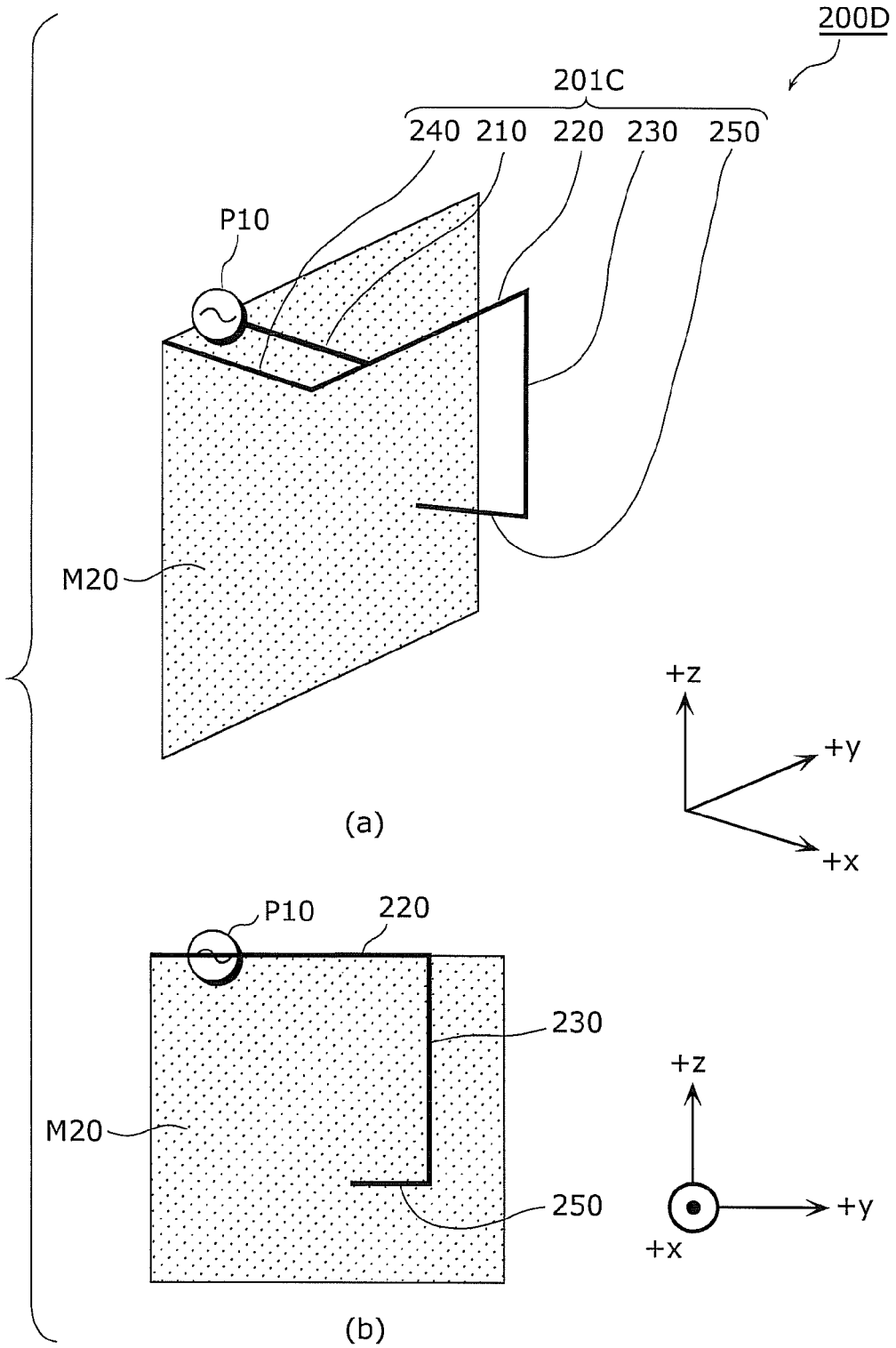
FIG. 24 is an illustration showing the configuration of the antenna in Modification 1 of Embodiment 1.

Also, like the antenna 200D shown in FIG. 24, the linear conductor 250 may be provided so as not to be parallel to any one of the x-axis, the y-axis and the z-axis. (A) in FIG. 24 is a perspective view of the antenna 200D. (B) in FIG. 24 is a view of the antenna 200D projected onto the z-y plane of the three-dimensional coordinate system.

Also in the antenna 200C and the antenna 200D, similarly to Embodiment 1, the size and shape of each component are defined so that the electromagnetic moments Mx, My, and Mz are equal.

As described above, according to Modification 1 of the present embodiment, the electrical length of the three-dimensional linear conductor 201C required to efficiently emit radio waves can be adjusted by the linear conductor 250. Also, the magnitude of each electromagnetic moment can be flexibly adjusted by the linear conductor 250. Consequently, the radio communication device 1000 equipped with the antenna 200C or the antenna 200D can be reduced in size. Also, flexible design of an antenna is possible.

Modification 2 of Embodiment 1

The radio communication device 1000 in Modification 2 of the present embodiment includes an antenna 200E instead of the antenna 200. Except for this, the configuration of the radio communication device 1000 is the same as that of the radio communication device 1000 of FIG. 1, thus detailed description is not repeated.

Figure 25:
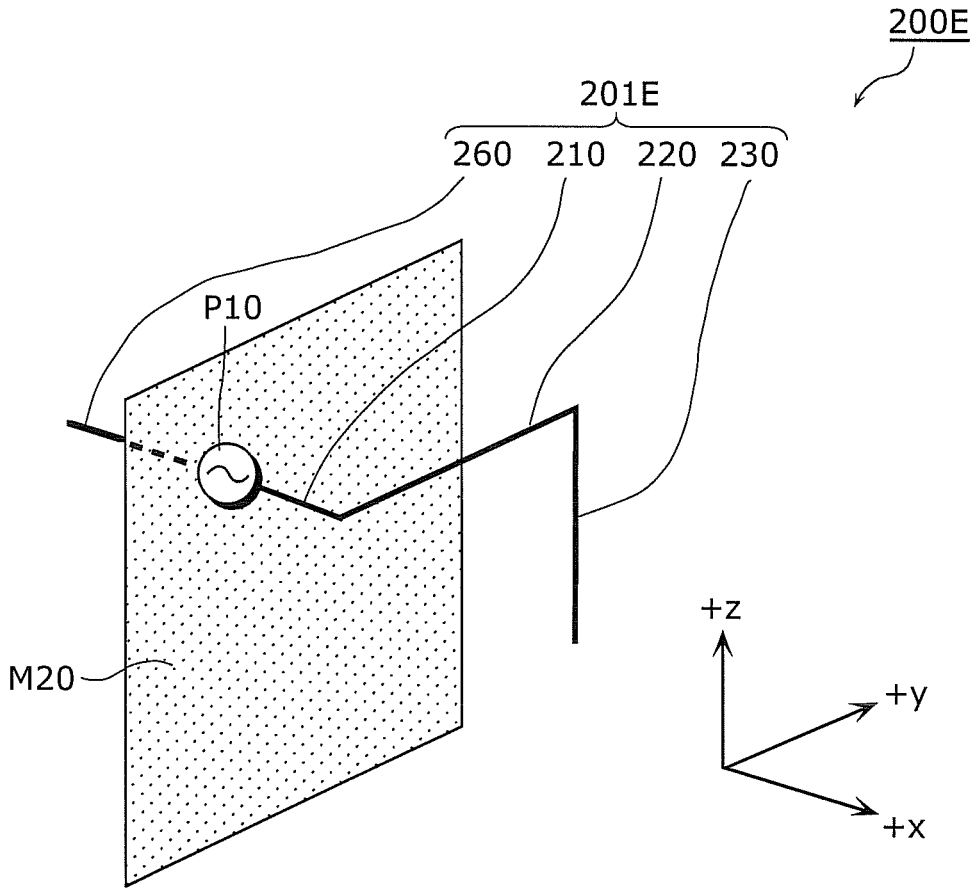
FIG. 25 is an illustration showing the configuration of an antenna in Modification 2 of Embodiment 1.

FIG. 25 is an illustration showing the configuration of the antenna 200E in Modification 2 of Embodiment 1

As shown in FIG. 25, the antenna 200E differs from the antenna 200 in that the antenna 200E includes a three-dimensional linear conductor 201E instead of the three-dimensional linear conductor 201. Except for this, the configuration of the antenna 200E is the same as that of the antenna 200, thus detailed description is not repeated.

The three-dimensional linear conductor 201E is a linear conductor in which the linear conductor 210, the linear conductor 220, the linear conductor 230, and a linear conductor 260 are integrally formed. That is to say, the three-dimensional linear conductor 201E does not include the linear conductor 240. The linear conductor 260 is a sixth linear conductor.

The linear conductor 260 is provided on the opposite side to the major surface of the planar conductor M20. The linear conductor 260 is provided perpendicularly to the major surface of the planar conductor M20. Also, the linear conductor 260 is provided so that the linear conductor 260 and the linear conductor 210 lie on the same line.

One end of the linear conductor 260 is electrically connected to the power feed point PT10 contained in the power feed region P10. That is to say, one end of linear conductor 210 which is electrically connected to the power feed point PT10 and one end of the linear conductor 260 which is electrically connected to the power feed point PT10 are electrically connected to each other.

Also in the antenna 200E, similarly to Embodiment 1, the size and shape of each component are defined so that the electromagnetic moments Mx, My, and Mz are equal.

As described above, according to Modification 2 of the present embodiment, the length of the linear conductor 210 in the x-axis direction can be reduced because of the linear conductor 260. Consequently, flexible design of an antenna can be supported.

The linear conductor 260 may be composed of the same metallic material as that for the linear conductor 210.

Modification 3 of Embodiment 1

The radio communication device 1000 in Modification 3 of the present embodiment includes an antenna 200F instead of the antenna 200. Except for this, the configuration of the radio communication device 1000 is the same as that of the radio communication device 1000 of FIG. 1, thus detailed description is not repeated.

Figure 26:
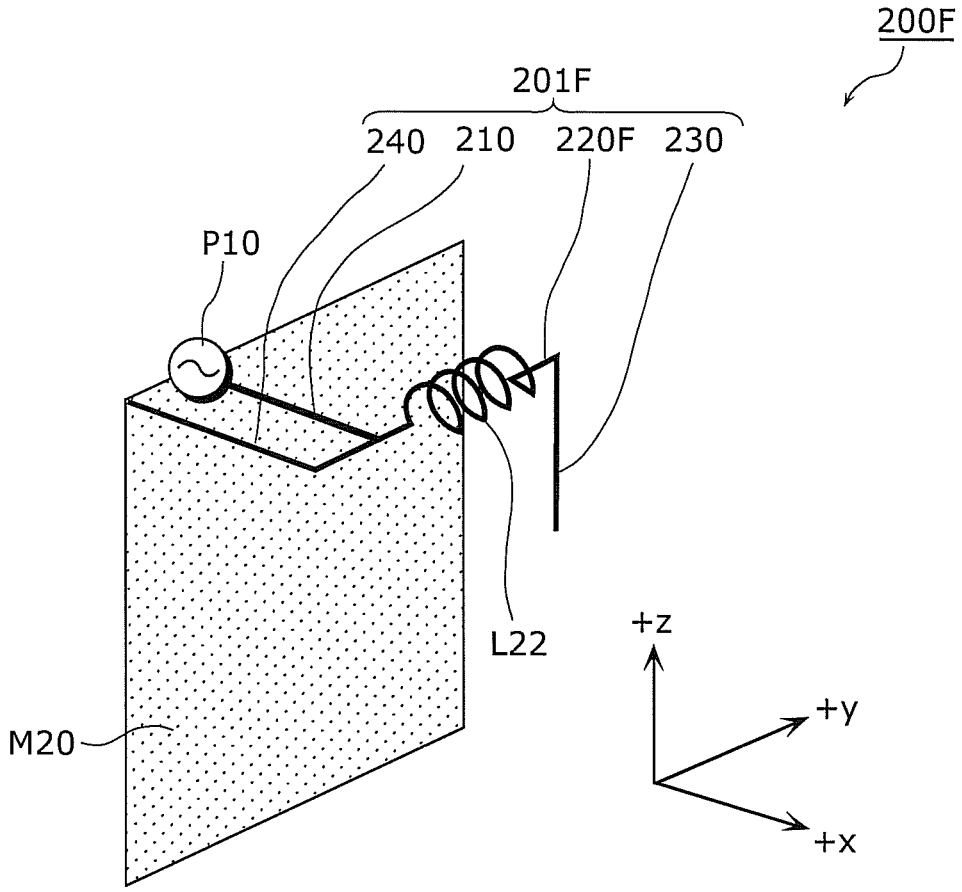
FIG. 26 is an illustration showing the configuration of an antenna in Modification 3 of Embodiment 1.

FIG. 26 is an illustration showing the configuration of the antenna 200F in Modification 3 of Embodiment 1.

As shown in FIG. 26, the antenna 200F differs from the antenna 200 in that the antenna 200F includes a three-dimensional linear conductor 201F instead of the three-dimensional linear conductor 201. Except for this, the configuration of the antenna 200F is the same as that of the antenna 200, thus detailed description is not repeated.

The three-dimensional linear conductor 201F differs from the three-dimensional linear conductor 201 of FIG. 3 in that the three-dimensional linear conductor 201F includes a linear conductor 220F instead of the linear conductor 220. Except for this, the configuration of the three-dimensional linear conductor 201F is the same as that of the three-dimensional linear conductor 201, thus detailed description is not repeated.

The three-dimensional linear conductor 201F is a linear conductor in which the linear conductor 210, the linear conductor 220F, the linear conductor 230, and the linear conductor 240 are integrally formed.

The linear conductor 220F is a linear conductor in which a loading coil L22 is inserted in all or part of the linear conductor 220 of FIG. 3.

Normally, the loading coil L22 is used to have an efficient flow of a current through an antenna by eliminating a reactance component thereof when the electrical length of the antenna is insufficient, or the physical length of the antenna is intended to be reduced.

Here, the physical length of a linear conductor which extends in the x-axis, the y-axis, or z-axis direction means the length of the linear conductor in the corresponding direction. For example, the physical length of the linear conductor 210 which extends in the x-axis direction is the length of the linear conductor 210 along the x-axis direction.

That is to say, the physical length of the linear conductor 220F which extends in the y-axis direction is the length of the linear conductor 220F along the y-axis direction.

Also in the antenna 200F, similarly to Embodiment 1, the size and shape of each component are defined so that the electromagnetic moments Mx, My, and Mz are equal.

As described above, according to Modification 3 of the present embodiment, the electrical length of the linear conductor 220F of the three-dimensional linear conductor 201F can be increased by using the loading coil L22, thus setting of a desired resonance frequency is made possible. Consequently, the emission characteristic of the antenna can be improved. Also, the antenna can be reduced in size because the physical length of the linear conductor in which the loading coil L22 is inserted can be reduced.

The loading coil L22 may be inserted in any one of the linear conductors 210, 230, and 240.

Modification 4 of Embodiment 1

The radio communication device 1000 in Modification 4 of the present embodiment includes an antenna 200G instead of the antenna 200. Except for this, the configuration of the radio communication device 1000 is the same as that of the radio communication device 1000 of FIG. 1, thus detailed description is not repeated.

Figure 27:
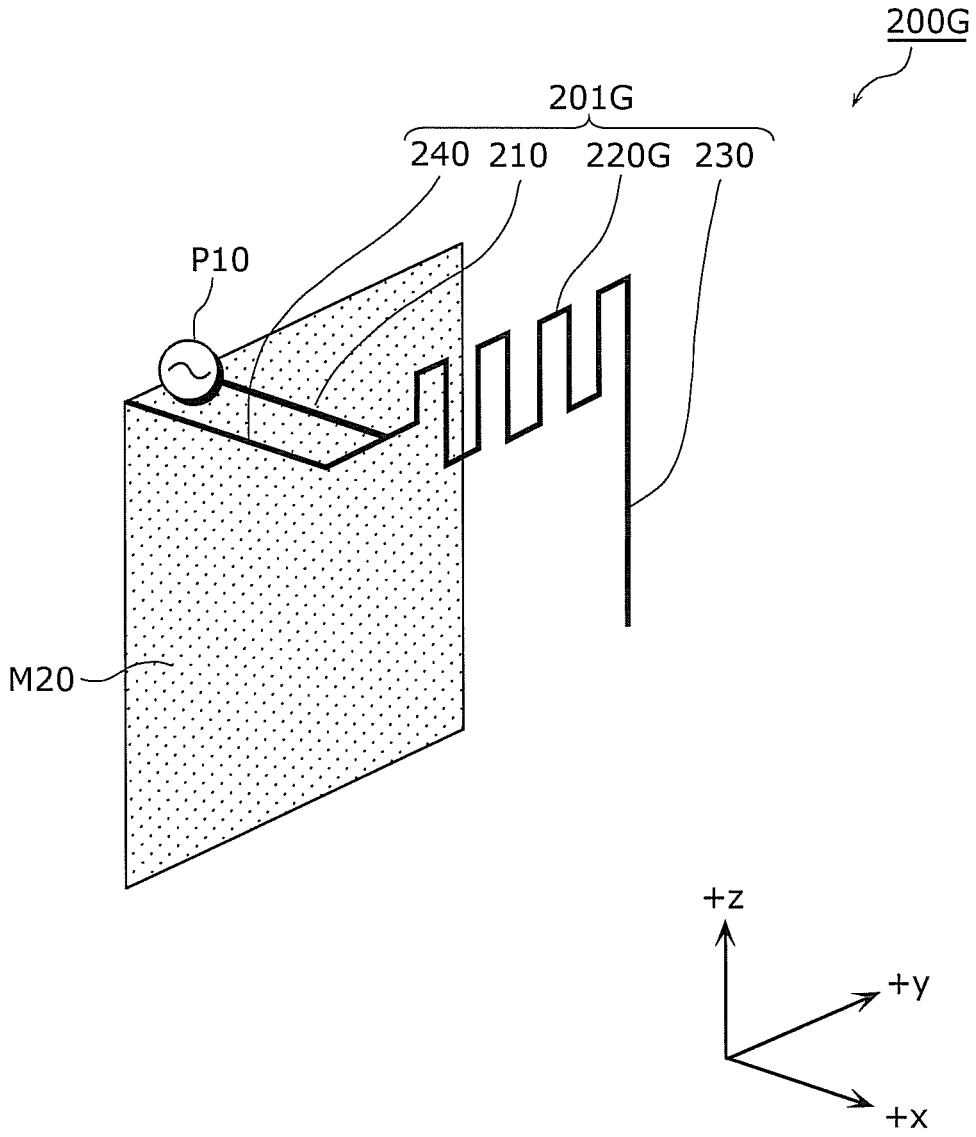
FIG. 27 is an illustration showing the configuration of an antenna in Modification 4 of Embodiment 1.

FIG. 27 is an illustration showing the configuration of the antenna 200G in Modification 4 of Embodiment 1.

As shown in FIG. 27, the antenna 200G differs from the antenna 200 in that the antenna 200G includes a three-dimensional linear conductor 201G instead of the three-dimensional linear conductor 201. Except for this, the configuration of the antenna 200G is the same as that of the antenna 200, thus detailed description is not repeated.

The three-dimensional linear conductor 201G differs from the three-dimensional linear conductor 201 of FIG. 3 in that the three-dimensional linear conductor 201G includes a linear conductor 220G instead of the linear conductor 220. Except for this, the configuration of the three-dimensional linear conductor 201G is the same as that of the three-dimensional linear conductor 201, thus detailed description is not repeated.

The three-dimensional linear conductor 201G is a linear conductor in which the linear conductor 210, the linear conductor 220G, the linear conductor 230, and the linear conductor 240 are integrally formed.

The three-dimensional linear conductor 201G is such that all or part of the linear conductor 220 of FIG. 3 is replaced by a meander shape (zigzag shape).

A meander-shaped conductor normally can achieve the miniaturization of an antenna, while maintaining the electrical length thereof. For this reason, the meander-shaped conductor is utilized for a miniaturized antenna which is used in a mobile phone or the like.

Also in the antenna 200G, similarly to Embodiment 1, the size and shape of each component are defined so that the electromagnetic moments Mx, My, and Mz are equal.

As described above, according to Modification 4 of the present embodiment, the electrical length of the antenna can be increased by using the meander-shaped conductor 201G. That is to say, the electrical length of the antenna can be flexibly adjusted. Accordingly, the frequency of the high frequency current that is used in the antenna for radio communication can be set to a desired resonance frequency. Consequently, the emission characteristic of the antenna can be improved. Also, miniaturization of the antenna can be achieved because the physical length of the linear conductor can be reduced by replacing the linear conductor by a meander-shaped conductor.

All or part of each of the linear conductors 210, 230, 240 may be replaced by a meander-shaped conductor.

Modification 5 of Embodiment 1

The radio communication device 1000 in Modification 5 of the present embodiment includes an antenna 200H instead of the antenna 200. Except for this, the configuration of the radio communication device 1000 is the same as that of the radio communication device 1000 of FIG. 1, thus detailed description is not repeated.

Figure 28:
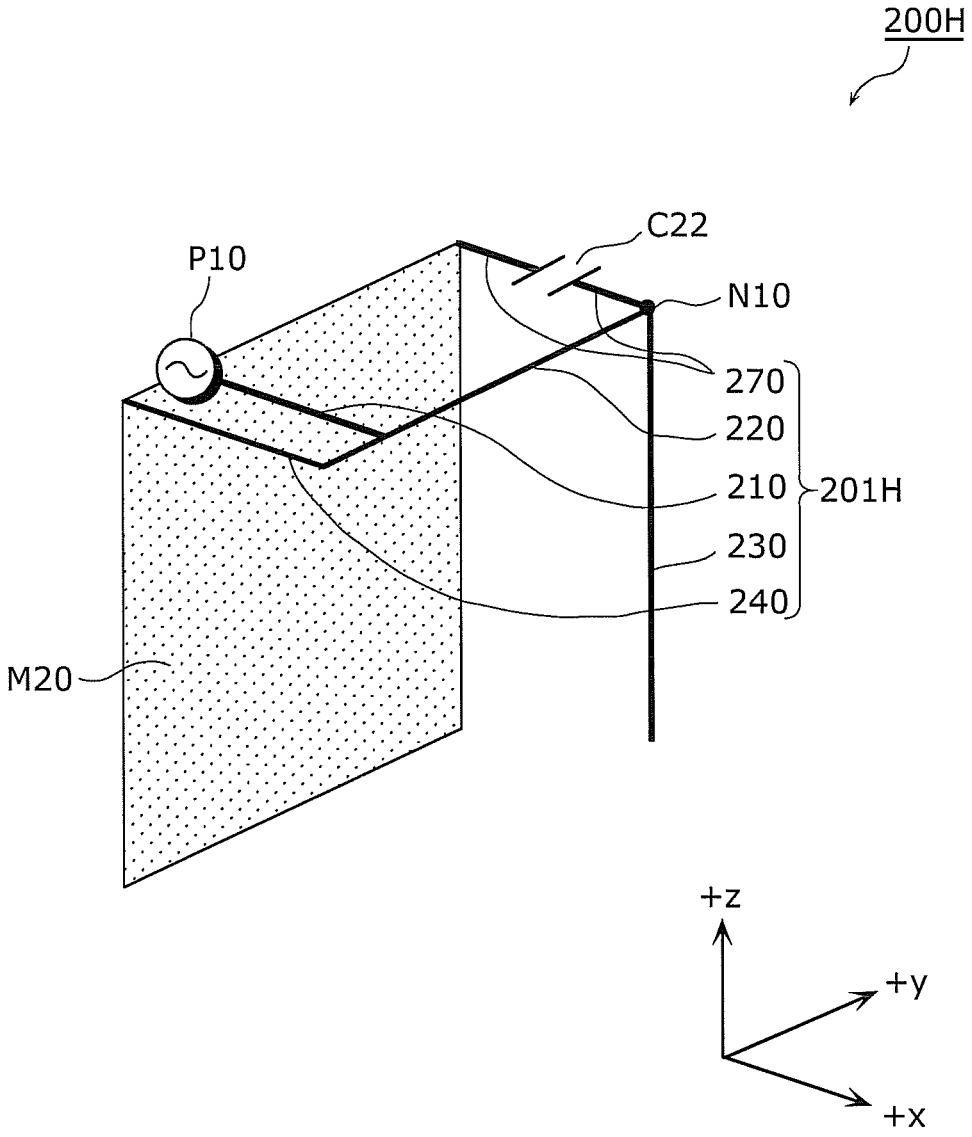
FIG. 28 is an illustration showing the configuration of an antenna in Modification 5 of Embodiment 1.

FIG. 28 is an illustration showing the configuration of the antenna 200H in Modification 5 of Embodiment 1.

As shown in FIG. 28, the antenna 200H differs from the antenna 200 in that the antenna 200H includes a three-dimensional linear conductor 201H instead of the three-dimensional linear conductor 201. Except for this, the configuration of the antenna 200H is the same as that of the antenna 200, thus detailed description is not repeated.

The three-dimensional linear conductor 201H differs from the three-dimensional linear conductor 201 of FIG. 3 in that the three-dimensional linear conductor 201H further includes a linear conductor 270. Except for this, the configuration of the three-dimensional linear conductor 201H is the same as that of the three-dimensional linear conductor 201, thus detailed description is not repeated.

The linear conductor 270 is provided parallel to the linear conductor 210. The linear conductor 270 is provided perpendicularly to the major surface of the planar conductor M20.

The three-dimensional linear conductor 201H is a linear conductor in which the linear conductor 210, the linear conductor 220, the linear conductor 230, and the linear conductor 240 are integrally formed.

A loading capacitor C22 is inserted in the linear conductor 270.

Normally, the loading capacitor C22 is used to have an efficient flow of a current through an antenna by eliminating a reactance component thereof when the electrical length of the antenna is insufficient, or the physical length of the antenna is intended to be reduced.

The contact point N10 between the linear conductor 220 and the linear conductor 230 is connected to the planar conductor M20 via the linear conductor 270. That is to say, the loading capacitor C22 is provided between the planar conductor M20 and the contact point N10 where the linear conductor 220 and the linear conductor 230 are in contact with each other. That is to say, the linear conductor 220 and the linear conductor 230 are electrically connected to the loading capacitor C22.

Also in the antenna 200H, similarly to Embodiment 1, the size and shape of each component are defined so that the electromagnetic moments Mx, My, and Mz are equal.

As described above, according to Modification 5 of the present embodiment, miniaturization of the antenna can be achieved because the physical length of the linear conductor 220 which is electrically connected to the loading capacitor C22 can be reduced by using the loading capacitor C22.

The loading capacitor C22 may be inserted into any one of the linear conductors 210, 230, and 240. That is to say, the loading capacitor C22 may be electrically connected to any one of the linear conductors 210, 230, and 240.

Modification 6 of Embodiment 1

Figure 29:
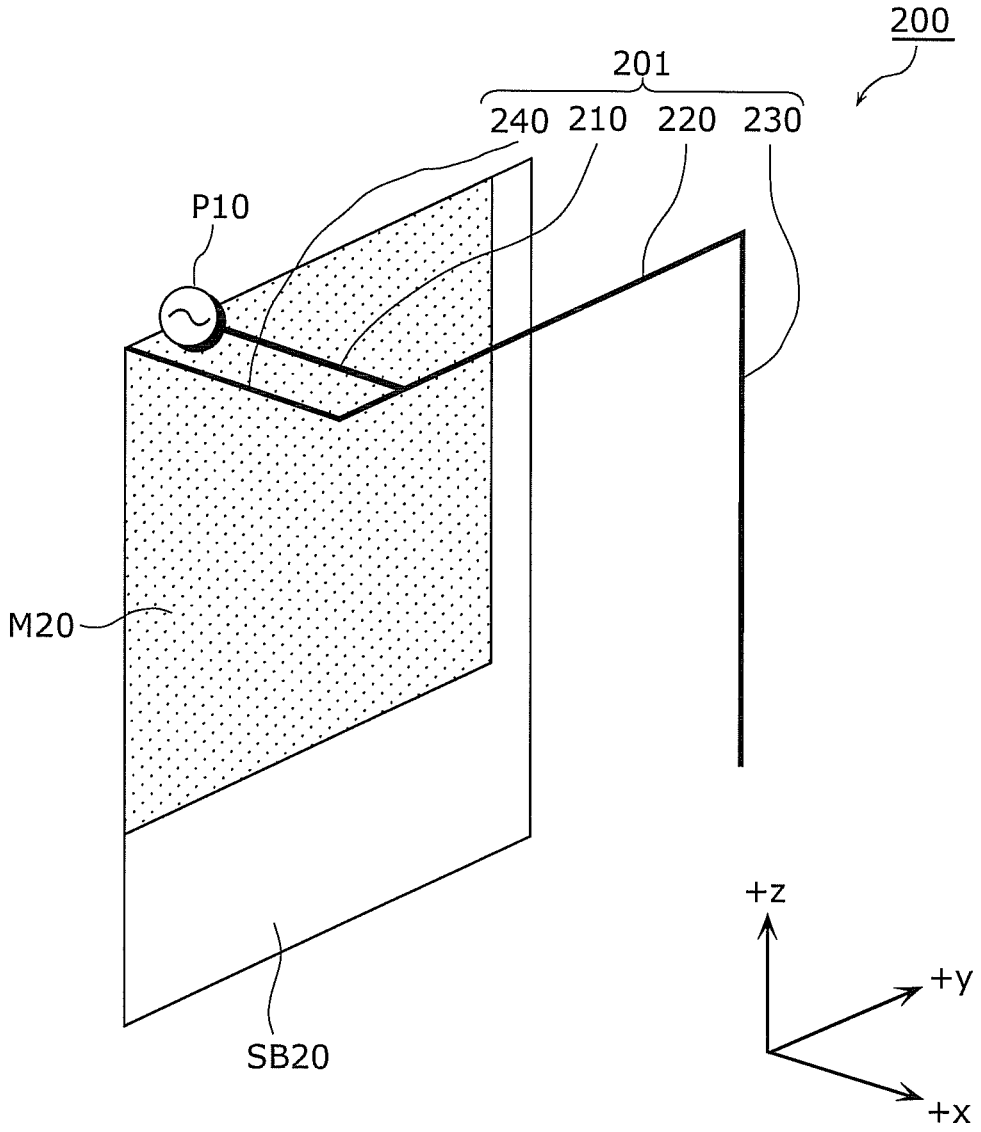
FIG. 29 is an illustration showing the configuration of an antenna in Modification 6 of Embodiment 1.

FIG. 29 is an illustration showing the configuration of the antenna 200 in Modification 6 of Embodiment 1. For the purpose of description, FIG. 29 shows a substrate SB20 which is not included in the antenna 200.

As shown in FIG. 29, the plane size of the planar conductor M20 included in the antenna 200 is different from the plane size of the substrate SB20.

In order to achieve an antenna that prevents an occurrence of a location (null point) in all directions on each of the orthogonal planes, where the electric field strength is significantly reduced, the size and shape of the antenna may be determined so that Expressions (1) to (4) are satisfied. Accordingly, even when the plane size of the planar conductor M20 is different from that of the substrate SB20, the size and shape of the antenna may be determined so that Expressions (1) to (4) are satisfied, thus flexible design of the antenna is possible.

Modification 7 of Embodiment 1

The radio communication device 1000 in Modification 7 of the present embodiment includes an antenna 200J instead of the antenna 200. Except for this, the configuration of the radio communication device 1000 is the same as that of the radio communication device 1000 of FIG. 1, thus detailed description is not repeated.

Figure 30:
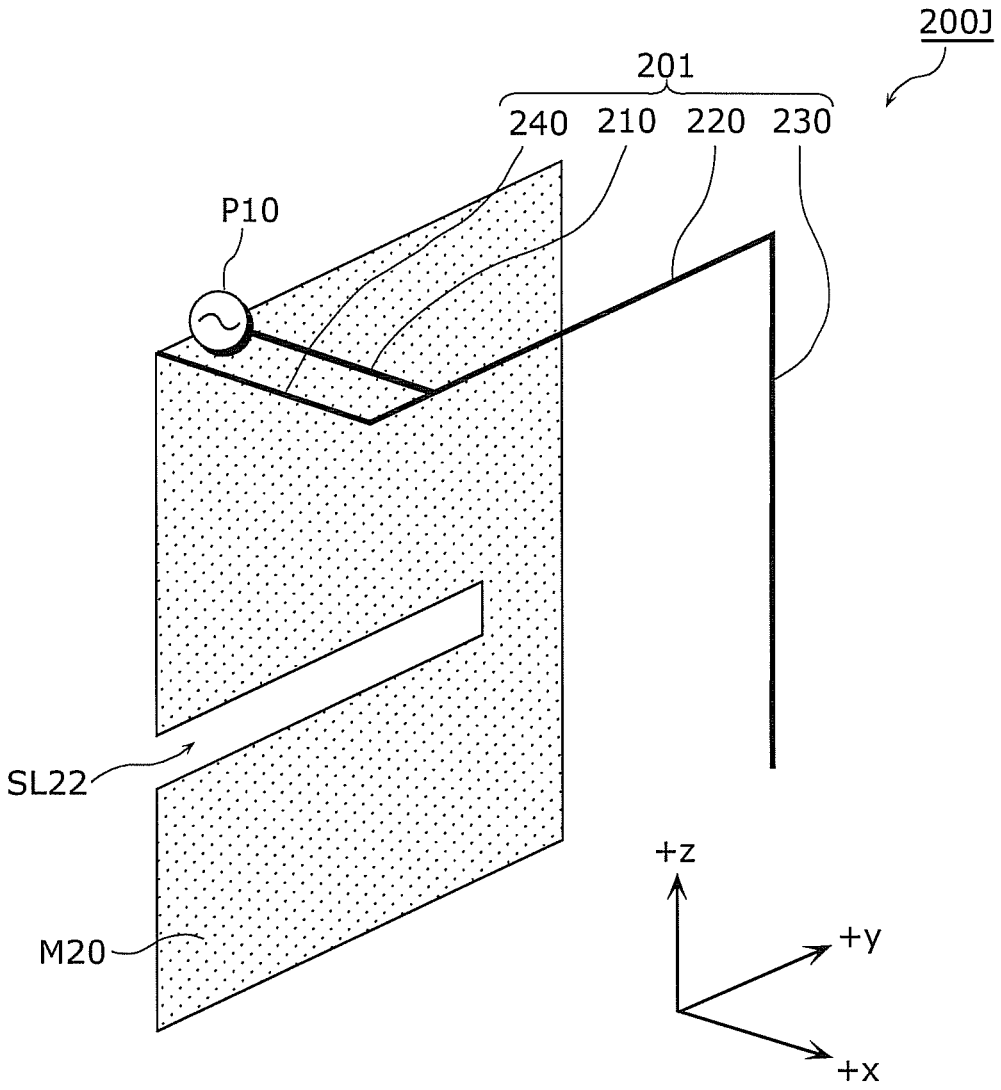
FIG. 30 is an illustration showing the configuration of an antenna in Modification 7 of Embodiment 1.

FIG. 30 is an illustration showing the configuration of the antenna 200J in Modification 7 of Embodiment 1.

As shown in FIG. 30, the antenna 200J differs from the antenna 200 in that the planar conductor M20 is provided with a slit SL22. Except for this, the configuration of the antenna 200J is the same as that of the antenna 200, thus detailed description is not repeated.

By adjusting the shape and size of the slit SL22, the amount of the current flowing through the planar conductor M20 can be controlled.

Also in the antenna 200J, similarly to Embodiment 1, the size and shape of each component are defined so that the electromagnetic moments Mx, My, and Mz are equal. That is to say, in the antenna 200J, the length of the planar conductor M20 in the z-axis direction and the length of the linear conductor 230 are defined so that the electromagnetic moments Mx, My, and Mz are equal. Accordingly, flexible design of the antenna is made possible by providing the slit SL22 in the planar conductor M20.

Matching Circuit

Figure 31:
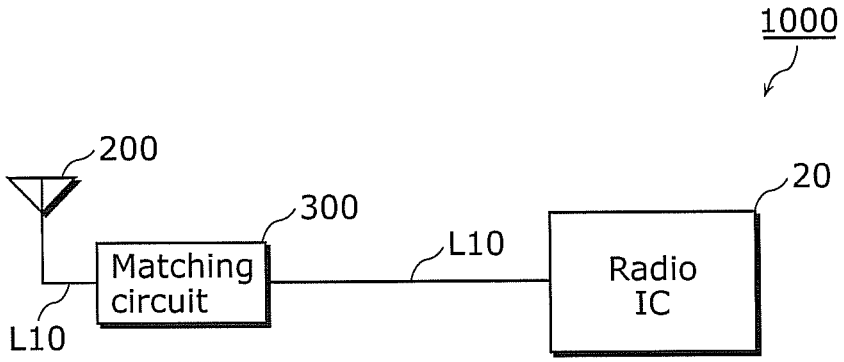
FIG. 31 is a diagram showing a matching circuit included in a radio communication device.
Figure 32:
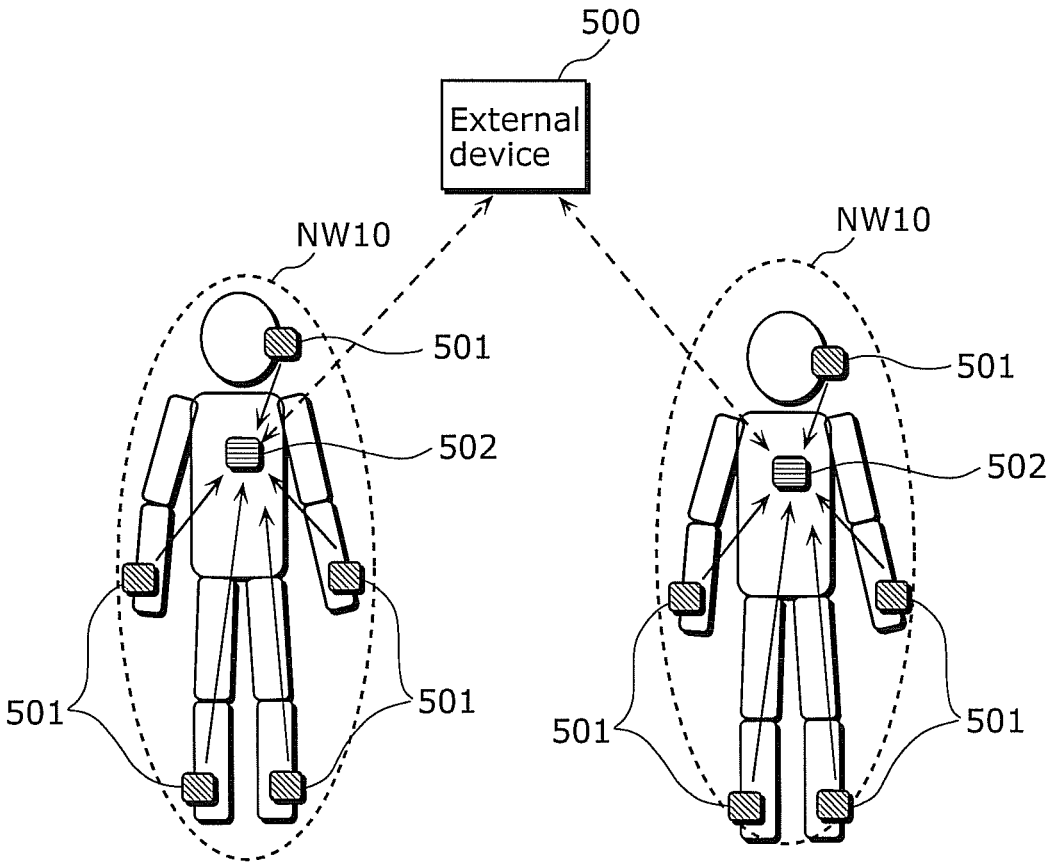
FIG. 32 is an illustration showing an example of a WBAN system configuration.
Figure 33:
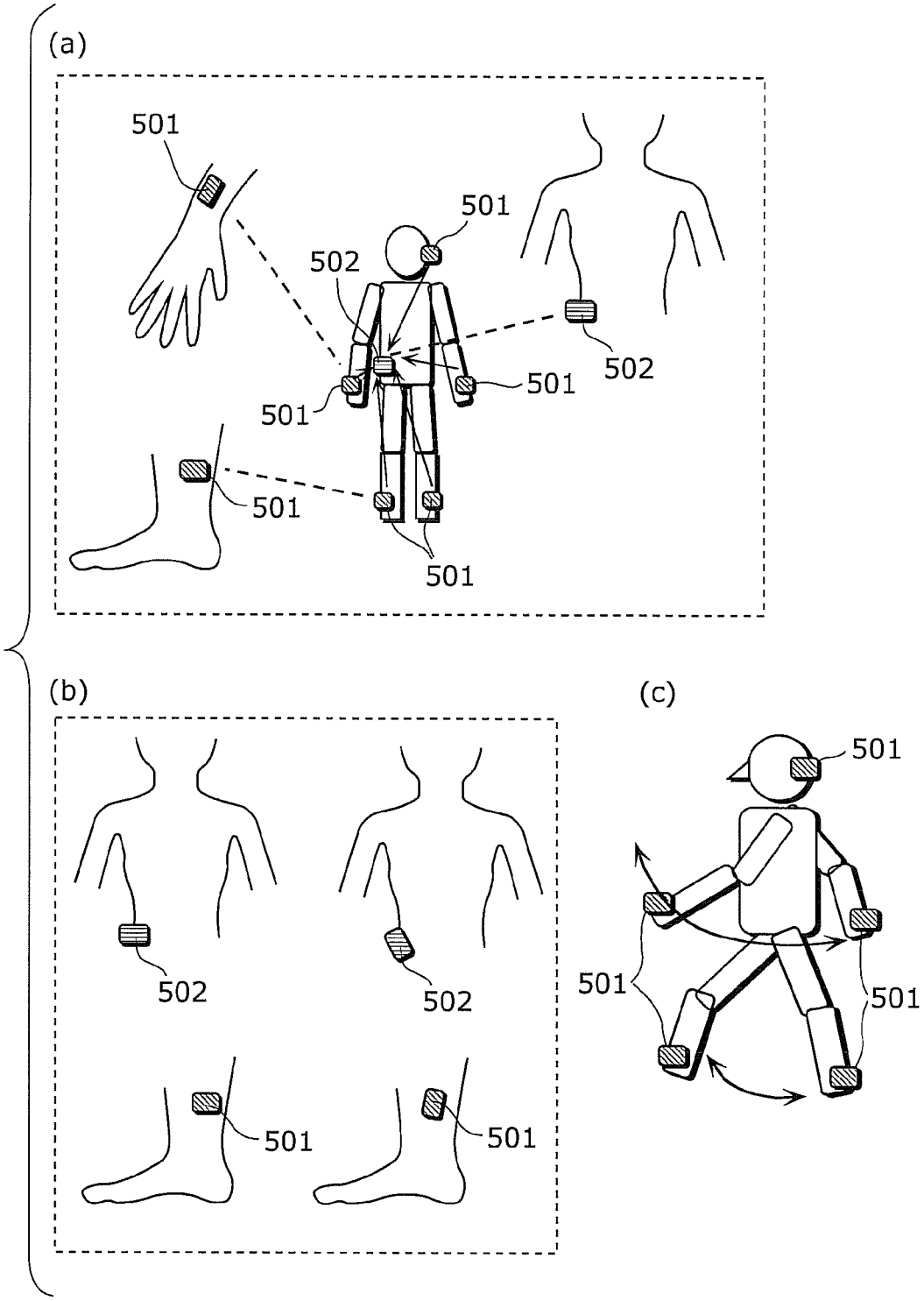
FIG. 33 is an illustration showing an example of how the radio communication device in the WBAN system is used.

FIG. 31 is a diagram showing the above-described matching circuit 300 which is included in the radio communication device 1000. The matching circuit 300 is mounted on the substrate SB20.

As shown in FIG. 31, the matching circuit 300 is disposed in the vicinity of the antenna 200, on the power feed line L10 interconnecting the antenna 200 and the radio IC 20.

The matching circuit 300 performs impedance matching so that each of the input impedance and the output impedance of the antenna 200 is set to 50Ω. Because the matching circuit 300 is a known circuit, detailed description of the matching circuit 300 is not given. The matching circuit 300 is constituted by passive elements, for example, a resistor, an inductor, or a capacitor.

The input impedance of the antenna 200 is the impedance as the antenna 200 is viewed from the power feed point PT10. The output impedance of the antenna 200 is the impedance as the radio IC 20 is viewed from the power feed point PT10.

As described above, by matching the input impedance of the antenna 200 to the output impedance thereof, the high frequency signal outputted from the radio IC 20 is efficiently emitted from the antenna 200. Also, the high frequency signal that is received by the antenna 200 can be efficiently transmitted to the radio IC.

The radio communication device 1000 may include any one of the above-described antennas 200A, 200B, 200C, 200D, 200E, 200F, 200G, 200H, and 200J instead of the antenna 200 shown in FIG. 31. In this case, the input impedance and the output impedance of the antenna (for example, the antenna 200A) provided in the radio communication device 1000 can be matched to each other by the matching circuit 300.

In the above, the antenna (for example, the antenna 200) in the present invention has been described based on the embodiments, however, the present invention is not limited to these embodiments. As long as not departing from the spirit of the present invention, modified embodiments obtained by making various modifications, which occur to those skilled in the art, to the present embodiment, and the embodiments that are constructed by combining the components of different embodiments are also included in the scope of the present invention.

It should be understood that the embodiments disclosed herein are for illustrative purposes in every point rather than limiting purposes. It is contemplated that the scope of the present invention is defined by the CLAIMS rather than the above description, and includes all modifications within the meaning and the range of equivalency of the CLAIMS.

INDUSTRIAL APPLICABILITY

The present invention can be utilized as an antenna which prevents an occurrence of a location on the orthogonal planes in the three-dimensional space, where the electric field strength is significantly reduced.

REFERENCE SIGNS LIST

20 Radio IC
200, 200A, 200B, 200C, 200D, 200E, 200F, 200G, 200H, 200J Antenna
201, 201C, 201E, 201F, 201G, 201H Three-dimensional linear conductor
210, 220, 220F, 220G, 230, 240, 250, 260, 270 Linear conductor
300 Matching circuit
1000 Radio communication device
C22 Loading capacitor
L10 Power feed line
L22 Loading coil
M20 Planar conductor
P10 Power feed region
PT10 Power feed point
SB20 Substrate
SL22 Slit

The invention claimed is:

1. An antenna which is used for radio communication, comprising:

a planar conductor which is grounded; and a three-dimensional linear conductor in which at least a first linear conductor, a second linear conductor, and a third linear conductor are integrally formed, wherein said first linear conductor is provided on a major surface side of said planar conductor and perpendicularly to the major surface, said second linear conductor is provided on the major surface side and parallel to the major surface, said third linear conductor is provided on the major surface side, parallel to the major surface, and perpendicularly to said second linear conductor, one end of said second linear conductor and one end of said third linear conductor are electrically connected to each other, said planar conductor is provided with a power feed point, to which a high frequency current used for the radio communication is externally supplied, the power feed point being electrically disconnected from said planar conductor, the power feed point is electrically connected to one end of said first linear conductor of said three-dimensional linear conductor, said three-dimensional linear conductor has a flow of the high frequency current therethrough, a current flows through said planar conductor due to the flow of the high frequency current through said three-dimensional linear conductor, said first linear conductor, said second linear conductor, and said third linear conductor are structured so as to satisfy a relationship of Mx=My=Mz, where Mx denotes an electromagnetic moment Ix×Lx, My denotes an electromagnetic moment Iy×Ly, and Mz denotes an electromagnetic moment Iz1×Lz1−Iz2×Lz2, Ix denotes a current flowing along an x-axis out of the high frequency current flowing through said three-dimensional linear conductor where Ix is represented by a positive value when the current flows in a +x direction, Iy denotes a current flowing along a y-axis out of the high frequency current flowing through said three-dimensional linear conductor where Iy is represented by a positive value when the current flows in a +y direction, Iz1 denotes a current flowing along a z-axis out of the current flowing through said planar conductor where Iz1 is represented by a positive value when the current flows in a +z direction, Iz2 denotes a current flowing along the z-axis out of the high frequency current flowing through said three-dimensional linear conductor where Iz2 is represented by a positive value when the current flows in the +z direction, Lx denotes a length of said three-dimensional linear conductor in the x-axis direction, Ly denotes a length of said three-dimensional linear conductor in the y-axis direction, Lz1 denotes a length of said planar conductor in the z-axis direction, Lz2 denotes a length of said three-dimensional linear conductor in the z-axis direction, in a three-dimensional coordinate system in which the x-axis, the y-axis and the z-axis are perpendicular to each other, the major surface of said planar conductor is parallel to a z-y plane of the three-dimensional coordinate system, the +x direction denotes one of two directions along the x-axis, −x direction denotes another of the two directions along the x-axis, the +y direction denotes one of two directions along the y-axis, −y direction denotes another of the two directions along the y-axis, the +z direction denotes one of two directions along the z-axis, −z direction denotes another of the two directions along the z-axis, Lx denotes a length of said first linear conductor, Ly denotes a length of said second linear conductor, Lz2 denotes a length of said third linear conductor, the difference between the maximum value and the minimum value of the amplitude of an emission characteristic of an electric field in the x-y plane emitted from the antenna is equal to or less than 5 dB over 360 degrees, the difference between the maximum value and the minimum value of the amplitude of an emission characteristic of an electric field in the z-y plane emitted from the antenna is equal to or less than 5 dB over 360 degrees, and the difference between the maximum value and the minimum value of the amplitude of an emission characteristic of an electric field in the z-x plane emitted from the antenna is equal to or less than 5 dB over 360 degrees.

2. The antenna according to claim 1, wherein said planar conductor has a quadrilateral shape, and the power feed point is provided in a vicinity of an edge of said planar conductor.

3. The antenna according to claim 1, wherein said three-dimensional linear conductor includes said first linear conductor, said second linear conductor, said third linear conductor, and a fourth linear conductor that are integrally formed, said fourth linear conductor is provided on the major surface side, said fourth linear conductor is parallel to said first linear conductor, said fourth linear conductor has a same length as said first linear conductor, and another end of said second linear conductor and said planar conductor are electrically connected to each other via said fourth linear conductor.

4. The antenna according to claim 3, wherein a length of said planar conductor in the z-axis direction, and respective lengths of said first linear conductor, said second linear conductor, said third linear conductor, and said fourth linear conductor are ¼ or less of a wavelength for a frequency of the high frequency current.

5. The antenna according to claim 3, wherein said three-dimensional linear conductor includes said first linear conductor, said second linear conductor, said third linear conductor, said fourth linear conductor, and a fifth linear conductor electrically connected to said third linear conductor that are integrally formed, and said fifth linear conductor is provided on the major surface side.

6. The antenna according to claim 1, wherein a length of said second linear conductor is less than or equal to a length of said planar conductor in the y-axis direction, and a length of said third linear conductor is less than or equal to a length of said planar conductor in the z-axis direction.

7. The antenna according to claim 1, wherein said three-dimensional linear conductor includes said first linear conductor, said second linear conductor, said third linear conductor, and a sixth linear conductor provided on a side of said planar conductor that is opposite to the major surface of said planar conductor that are integrally formed, said sixth linear conductor is provided such that said sixth linear conductor and said first linear conductor lie on a same line, one end of said sixth linear conductor is electrically connected to the power feed point, and the one end of said first linear conductor electrically connected to the power feed point, and the one end of said sixth linear conductor electrically connected to the power feed point are electrically connected to each other.

8. The antenna according to claim 1, wherein a loading coil is inserted in at least one of said first linear conductor, said second linear conductor, and said third linear conductor.

9. The antenna according to claim 1, wherein at least one of said first linear conductor, said second linear conductor, and said third linear conductor is meander-shaped.

10. The antenna according to claim 1, wherein at least one of said first linear conductor, said second linear conductor, and said third linear conductor is connected to a loading capacitor.

11. The antenna according to claim 1, wherein said planar conductor is further provided with a slit.

12. The antenna according to claim 1, wherein an input impedance of said antenna and an output impedance of said antenna are matched to each other by an external matching circuit.

13. A radio communication device which performs radio communication using said antenna according to claim 1.

* * * * *